US011296451B2

(12) United States Patent
Mori et al.

(10) Patent No.: US 11,296,451 B2
(45) Date of Patent: Apr. 5, 2022

(54) CONNECTION TERMINAL AND TERMINAL-EQUIPPED ELECTRIC WIRE

(71) Applicant: Yazaki Corporation, Tokyo (JP)

(72) Inventors: Yuki Mori, Tochigi (JP); Takashi Sone, Shizuoka (JP); Daisuke Yamanashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/028,375

(22) Filed: Sep. 22, 2020

(65) Prior Publication Data

US 2021/0091503 A1 Mar. 25, 2021

(30) Foreign Application Priority Data

Sep. 24, 2019 (JP) ..... JP2019-172788

(51) Int. Cl.
*H01R 13/44* (2006.01)
*H01R 13/502* (2006.01)
*H01R 13/516* (2006.01)

(52) U.S. Cl.
CPC ..... *H01R 13/44* (2013.01); *H01R 13/502* (2013.01); *H01R 13/516* (2013.01)

(58) Field of Classification Search
CPC .. H01R 13/44; H01R 2201/26; H01R 13/447; H01R 13/64; H01R 13/713
See application file for complete search history.

(56) References Cited

U.S. PATENT DOCUMENTS

| | | | | |
|---|---|---|---|---|
| 5,360,349 | A | 11/1994 | Provencher et al. | |
| 6,146,211 | A * | 11/2000 | Okamoto | H01R 13/44 439/825 |
| 2008/0261420 | A1* | 10/2008 | Riddle | H01R 24/28 439/134 |
| 2013/0052880 | A1 | 2/2013 | Wu | |
| 2013/0090012 | A1* | 4/2013 | Natter | H01R 13/04 29/874 |

(Continued)

FOREIGN PATENT DOCUMENTS

| | | | |
|---|---|---|---|
| FR | 2703518 | A1 | 10/1994 |
| JP | 2014-078402 | A | 5/2014 |

(Continued)

*Primary Examiner* — Truc T Nguyen
(74) *Attorney, Agent, or Firm* — Sughrue Mion, PLLC

(57) ABSTRACT

A connection terminal includes: a terminal fitting; an insulating covering member attachable and detachable from one end in a virtual axis direction of the terminal fitting along the virtual axis direction; and a locking structure undetachably locking the covering member to the terminal fitting. The covering member includes two covering portions sandwiching and covering, in a direction orthogonal to the virtual axis direction, covering target portions at opposite ends of the terminal fitting, the covering target portions are areas capable of being finger-touch prevention targets, the locking structure includes, for each of combinations of the covering target portions and the covering portions, a locking protrusion provided in one of the covering target portion and the covering portion, and a locking groove provided in the other of the covering target portion and the covering portion and configured to lock the locking protrusion.

9 Claims, 27 Drawing Sheets

(56) References Cited

U.S. PATENT DOCUMENTS

| | | | | |
|---|---|---|---|---|
| 2015/0200481 | A1* | 7/2015 | Fukushima | H01R 13/405 439/752 |
| 2016/0064849 | A1* | 3/2016 | Eckel | H01R 24/66 439/135 |
| 2016/0126657 | A1* | 5/2016 | Hirakawa | H01R 4/184 439/733.1 |
| 2017/0194740 | A1 | 7/2017 | Nakazawa | |
| 2018/0294600 | A1* | 10/2018 | Loncar | H01R 4/56 |
| 2018/0358732 | A1 | 12/2018 | Yamanashi et al. | |
| 2019/0207349 | A1* | 7/2019 | Yuan | H01R 31/06 |

FOREIGN PATENT DOCUMENTS

| | | | |
|---|---|---|---|
| JP | 2014-179290 | A | 9/2014 |
| JP | 2017-123223 | A | 7/2017 |
| JP | 2019-003744 | A | 1/2019 |

* cited by examiner

CONNECTION TERMINAL AND TERMINAL-EQUIPPED ELECTRIC WIRE

CROSS-REFERENCE TO RELATED APPLICATION(S)

The present application claims priority to and incorporates by reference the entire contents of Japanese Patent Application No. 2019-172788 filed in Japan on Sep. 24, 2019.

BACKGROUND OF THE INVENTION

1. Field of the Invention

The present invention relates to a connection terminal and a terminal-equipped electric wire.

2. Description of the Related Art

In a conventional connector, a connection terminal accommodated within a housing thereof is physically and electrically connected to a mating connection terminal of a mating connector inserted therein from an opening of the housing. Thus, the connection terminal is accommodated within the housing in an exposed state visible from the opening. In this type of connector, when the connection terminal is placed at a position allowing an operator or the like to touch the connection terminal with his/her finger(s) through the opening of the housing, a terminal fitting constituting the connection terminal may be partially covered with an insulating covering member. Japanese Patent Application Laid-open Nos. 2014-78402, 2014-179290, 2017-123223, and 2019-3744 disclose such a connection terminal having a terminal fitting partially covered with an insulating covering member.

Such a connection terminal has an area to be covered with an insulating covering member, optimized for each connector to which the connection terminal is applied. Thus, a need exists to easily provide the insulating covering member for the conventional connection terminal.

SUMMARY OF THE INVENTION

It is an object of the present invention to provide a connection terminal and a terminal-equipped electric wire capable of easily preventing a finger touch.

In order to achieve the above mentioned object, a connection terminal according to one aspect of the present invention includes a terminal fitting; an insulating covering member attachable to and detachable from the terminal fitting from one end in a virtual axis direction of the terminal fitting along the virtual axis direction; and a locking structure provided between the terminal fitting and the covering member and configured to undetachably lock the covering member to the terminal fitting, wherein the covering member includes two covering portions configured to sandwich and cover, in a direction orthogonal to the virtual axis direction, covering target portions disposed at opposite ends in the orthogonal direction of the terminal fitting, the covering target portions are areas capable of being finger-touch prevention targets to be prevented from being touched by a finger when accommodated within a casing of a connector, the locking structure includes, for each of combinations of the covering target portions and the covering portions arranged opposite to each other in the orthogonal direction, a locking protrusion provided in one of the covering target portion and the covering portion, and a locking groove provided in the other of the covering target portion and the covering portion and configured to lock the locking protrusion in the virtual axis direction when the locking protrusion is inserted thereinto, and each of the covering portions has such flexibility as to enable elastic deformation along a lock release direction for releasing a lock state between the locking protrusion and the locking groove for the covering portion.

According to another aspect of the present invention, in the connection terminal, it is possible to configure that the pair of the locking protrusion and the locking groove is formed to set the orthogonal direction as the lock release direction.

According to still another aspect of the present invention, in the connection terminal, it is possible to configure that the covering member includes a sub covering portion configured to cover an end surface at the end in the virtual axis direction of the terminal fitting in addition to two main covering portions as the covering portions.

According to still another aspect of the present invention, in the connection terminal, it is possible to configure that the sub covering portion is coupled to each of the two main covering portions, and the pair of the locking protrusion and the locking groove is formed to set a direction orthogonal to both the virtual axis direction and an opposing direction of the two main covering portions as the lock release direction.

According to still another aspect of the present invention, in the connection terminal, it is possible to configure that the terminal fitting includes an electrical connection portion formed in a rectangular plate shape, at least one of two flat surfaces along the virtual axis direction of the electrical connection portion being used as a contact portion with a mating connection terminal, and the covering target portions are individually disposed on end surfaces on two sides along the virtual axis direction of the electrical connection portion.

In order to achieve the above mentioned object, a terminal-equipped electric wire according to still another aspect of the present invention includes an electric wire; and a connection terminal physically and electrically connected to the electric wire, wherein the connection terminal includes: a terminal fitting; an insulating covering member attachable to and detachable from the terminal fitting from one end in a virtual axis direction of the terminal fitting along the virtual axis direction; and a locking structure provided between the terminal fitting and the covering member and configured to undetachably lock the covering member to the terminal fitting, the covering member includes two covering portions configured to sandwich and cover, in a direction orthogonal to the virtual axis direction, covering target portions disposed at opposite ends in the orthogonal direction of the terminal fitting, the covering target portions are areas capable of being finger-touch prevention targets to be prevented from being touched by a finger when accommodated within a casing of a connector, the locking structure includes, for each of combinations of the covering target portions and the covering portions arranged opposite to each other in the orthogonal direction, a locking protrusion provided in one of the covering target portion and the covering portion, and a locking groove provided in the other of the covering target portion and the covering portion and configured to lock the locking protrusion in the virtual axis direction when the locking protrusion is inserted thereinto, and each of the covering portions has such flexibility as to enable elastic deformation along a lock release direction for releasing a lock state between the locking protrusion and the locking groove for the covering portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
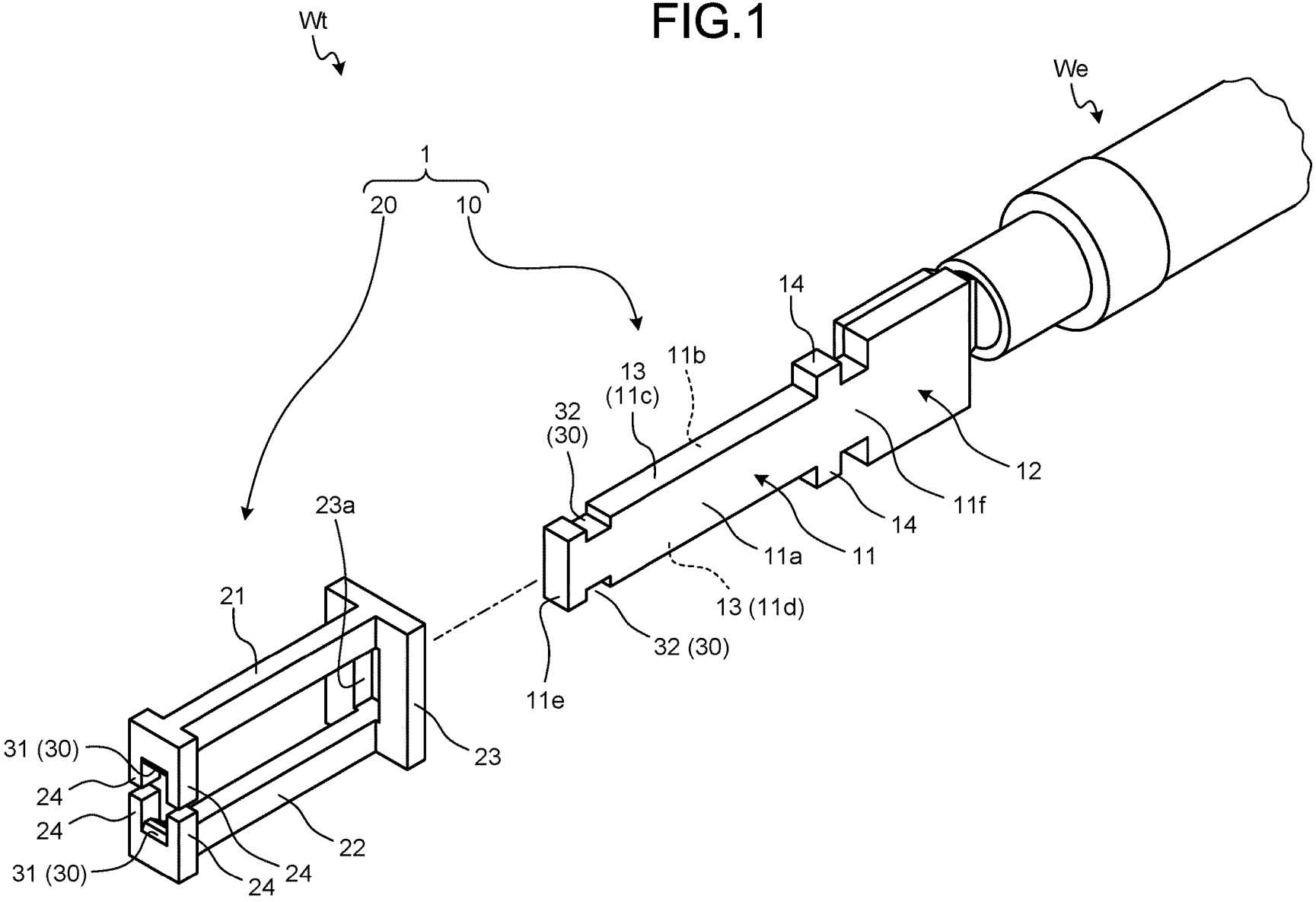
FIG. 1 is an exploded perspective view illustrating a connection terminal and a terminal-equipped electric wire of an embodiment.
Figure 2:
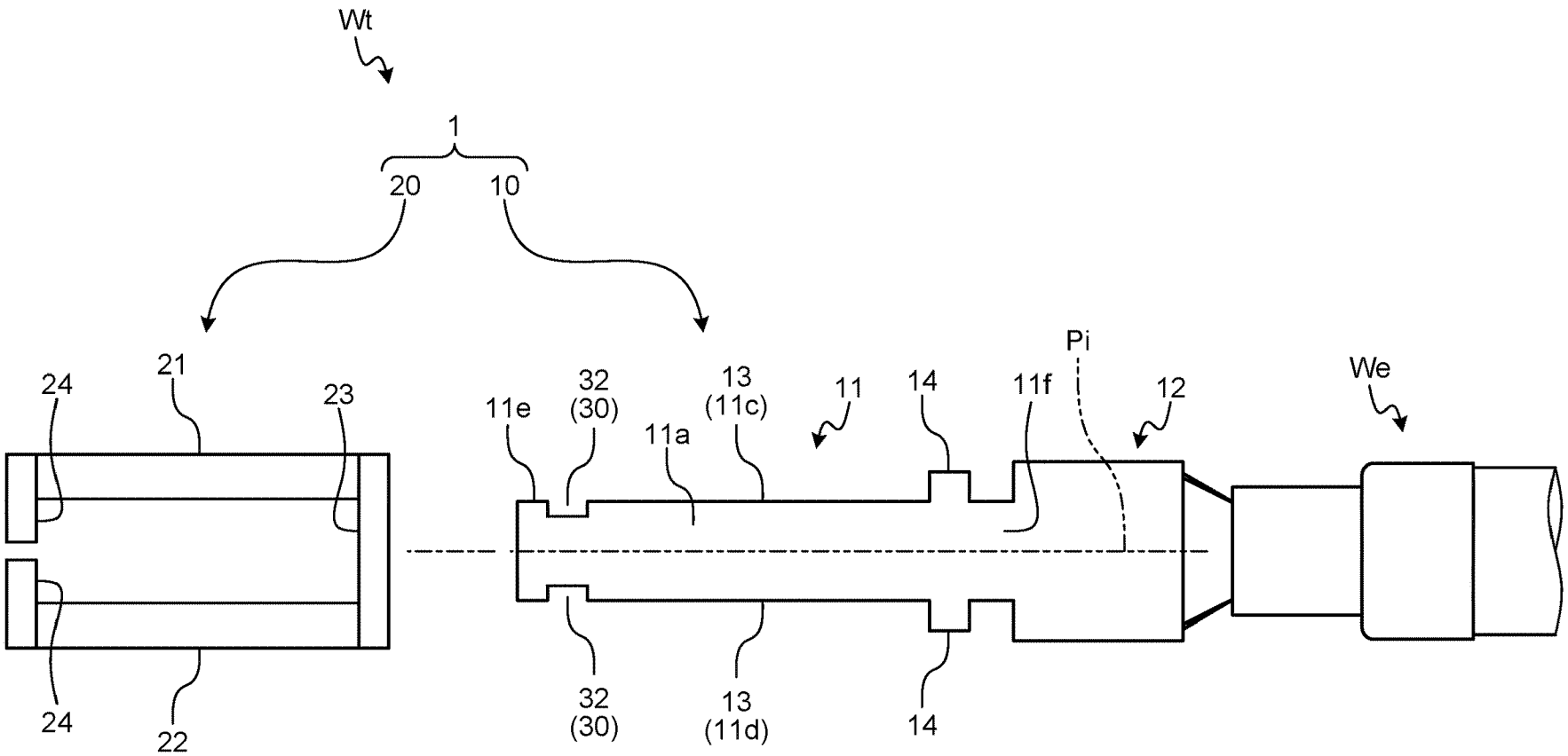
FIG. 2 is an exploded plan view of the connection terminal and the terminal-equipped electric wire of the embodiment as viewed from a contact portion side.
Figure 3:
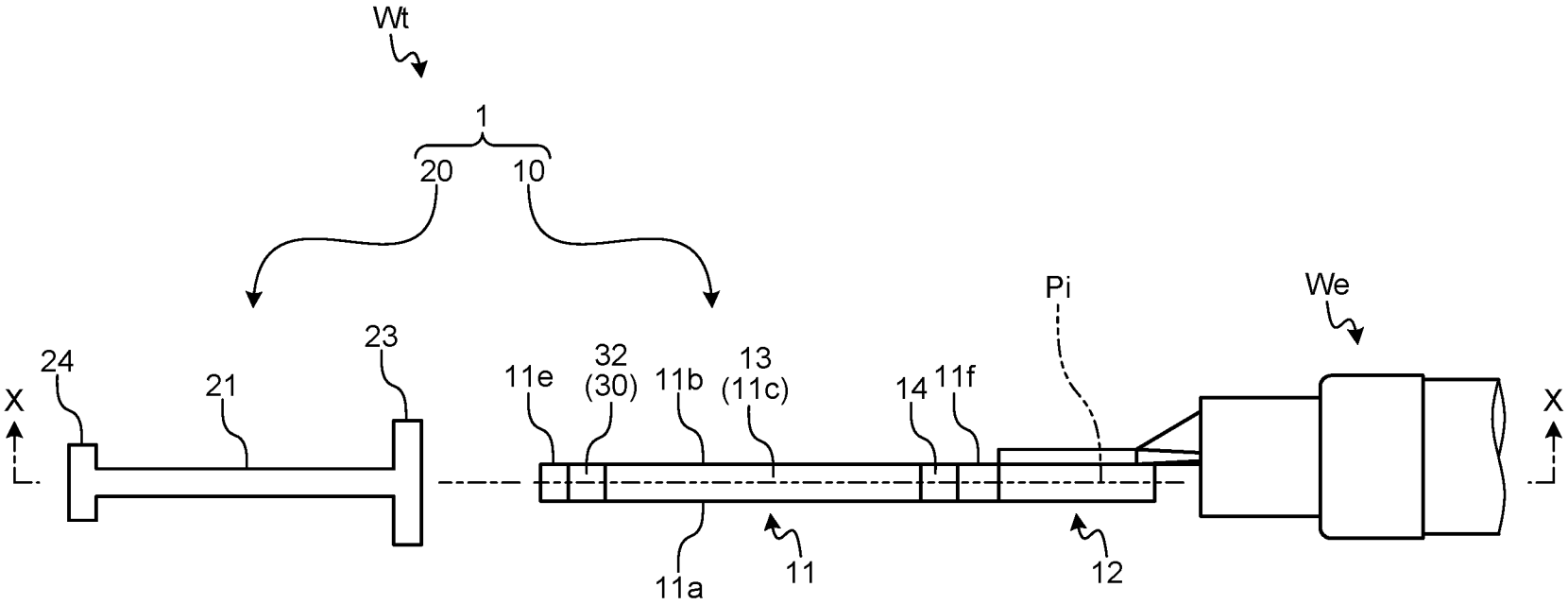
FIG. 3 is an exploded plan view of the connection terminal and the terminal-equipped electric wire of the embodiment as viewed from a covering target portion side.

Hereinafter, an embodiment(s) of a connection terminal and a terminal-equipped electric wire according to the present invention will be described in detail based on the drawings. Note that the embodiment(s) is/are not intended to limit the invention.

Embodiment

One embodiment of the connection terminal and the terminal-equipped electric wire according to the present invention will be described based on FIGS. 1 to 15.

Reference numeral 1 in FIGS. 1 to 10 denotes a connection terminal of the present embodiment. Reference character Wt in FIGS. 1 to 10 denotes a terminal-equipped electric wire of the present embodiment. The connection terminal 1 includes a terminal fitting 10 and an insulating covering member 20 attachable to and detachable from the terminal fitting 10 from one end in an axial direction of a virtual axis Pi (FIGS. 2 to 4, 6, 7, 9, and 10) (referred to as "virtual axis direction" below) of the terminal fitting 10 along the virtual axis direction. The terminal-equipped electric wire Wt includes the connection terminal 1 and an electric wire We. The connection terminal 1 is physically and electrically connected to the electric wire We (FIGS. 1 to 10). In the following, the connection terminal 1 and the terminal-equipped electric wire Wt will be described along with a description of a connector 501 as an example to which the connection terminal 1 and the terminal-equipped electric wire Wt are applied (FIGS. 11 to 14).

The connector 501 in this example is electrically connected to a mating connector 601 (FIGS. 11 to 13 and 15) to electrically connect a connection target electrically connected to the connector 501 and a connection target electrically connected to the mating connector 601. The mating connector 601 provided in a mating apparatus 600 (FIGS. 11 to 13) is a connection target of the connector 501. The connector 501 in this example electrically connects the connection terminal 1 provided therein to a mating connection terminal 610 (FIG. 15) of the mating connector 601, thereby electrically connecting an apparatus (not illustrated), to which the connector 501 is electrically connected via the electric wire We, to the mating apparatus 600.

The connector 501 includes two connection terminals 1 mounted on ends of two electric wires We. Meanwhile, the mating connector 601 includes two mating connection terminals 610 provided corresponding to the connection terminals 1 of the connector 501. One of each connection terminal 1 and each mating connection terminal 610 is formed as a male terminal, and the other as a female terminal. In this example, the connection terminals 1 are formed as male terminals, and the mating connection terminals 610 as female terminals.

The terminal fittings 10 of the connection terminals 1 and the mating connection terminals 610 are formed of a conductive material such as a metal material. In this example, a conductive metal plate is used as a base material for forming the terminal fittings 10 and the mating connection terminals 610 by cutting or press forming such as bending. Each terminal fitting 10 has a male electrical connection portion 11 to be physically and electrically connected to the corresponding mating connection terminal 610, and an electric wire connection portion 12 to be physically and electrically connected to the end of the corresponding electric wire We (FIGS. 1 to 10). Meanwhile, each mating connection terminal 610 has a female electrical connection portion 611 to be physically and electrically connected to the electrical connection portion 11 of the corresponding terminal fitting 10 (FIG. 15).

The electrical connection portion 11 is formed in a rectangular plate shape (FIGS. 1 to 10). The virtual axis Pi is set to extend along two flat surfaces (a first wall surface 11*a*, a second wall surface lib) in the center between these flat surfaces and along an extension direction of end surfaces (a first end surface 11*c*, a second end surface 11*d*) on two sides in the center between these end surfaces in the electrical connection portion 11 (FIGS. 2, 3, 6, and 7). Thus, the remaining two sides of the electrical connection portion 11 are orthogonal to the virtual axis direction. One of the remaining two sides is a front end 11*e*, and the other is a rear end 11*f* (FIGS. 1 to 7, 9, and 10). The covering member 20 is attached and detached from the side at the front end 11*e* of the electrical connection portion 11. The electric wire connection portion 12 is disposed on the side at the rear end 11*f* of the electrical connection portion 11.

In the electrical connection portion 11, at least one of the first wall surface 11*a* and the second wall surface 11*b* along the virtual axis direction is used as a contact portion with the mating connection terminal 610. That is, at least one of the first wall surface 11*a* and the second wall surface 11*b* of the electrical connection portion 11 is physically and electrically connected to the electrical connection portion 611 of the mating connection terminal 610. Each electrical connection portion 611 has two contact portions (a first contact portion 611*a*, a second contact portion 611*b*) arranged opposite to each other with a distance therebetween so as to allow the corresponding electrical connection portion 11 to be fitted therebetween (FIG. 15). Fitting the electrical connection portion 11 between the first contact portion 611*a* and the second contact portion 611*b* enables contact between the first wall surface 11*a* and the first contact portion 611*a*, and between the second wall surface 11*b* and the second contact portion 611*b*.

Figure 11:
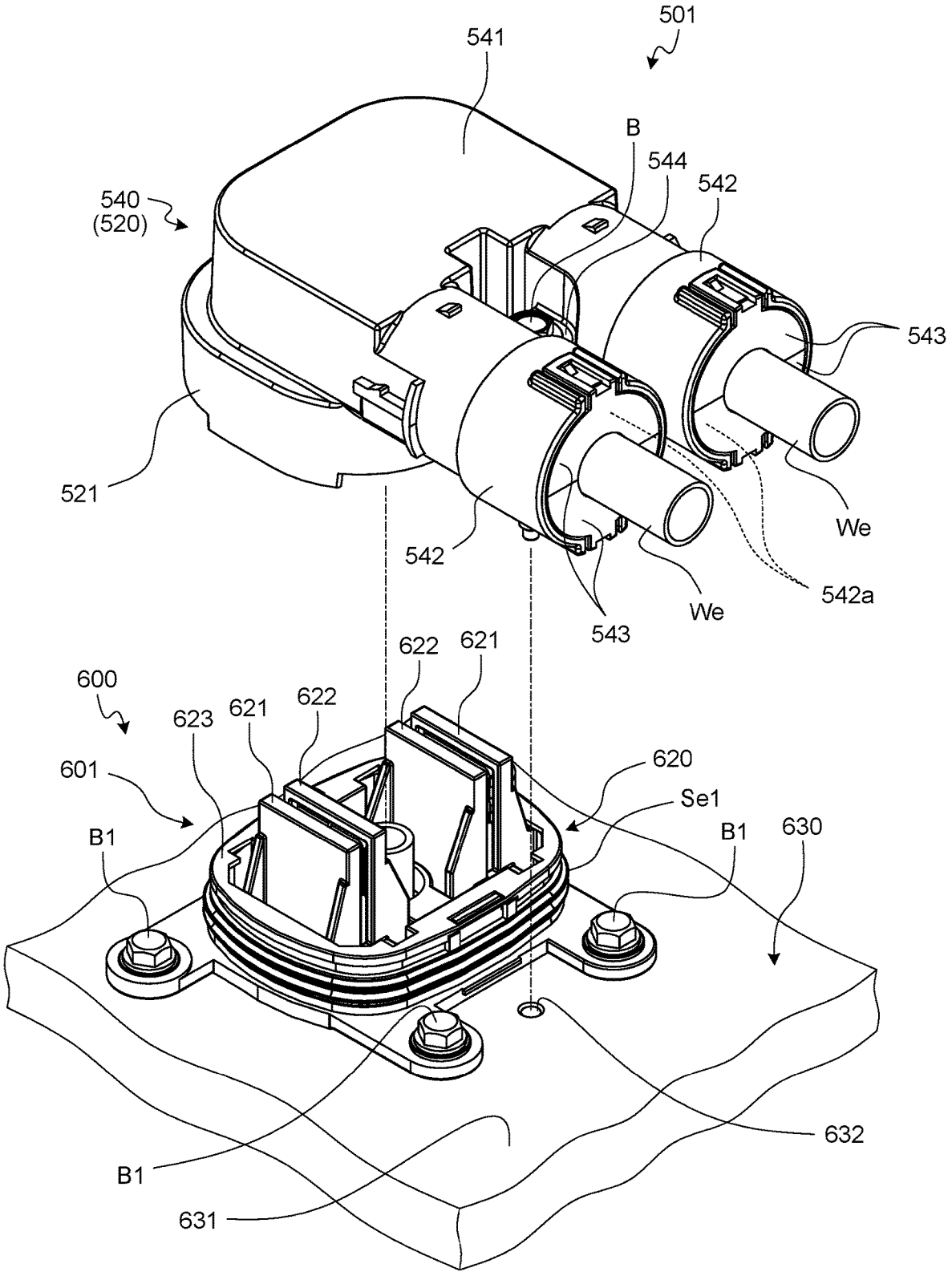
FIG. 11 is a perspective view illustrating a connector and a mating connector before fitting connection.
Figure 15:
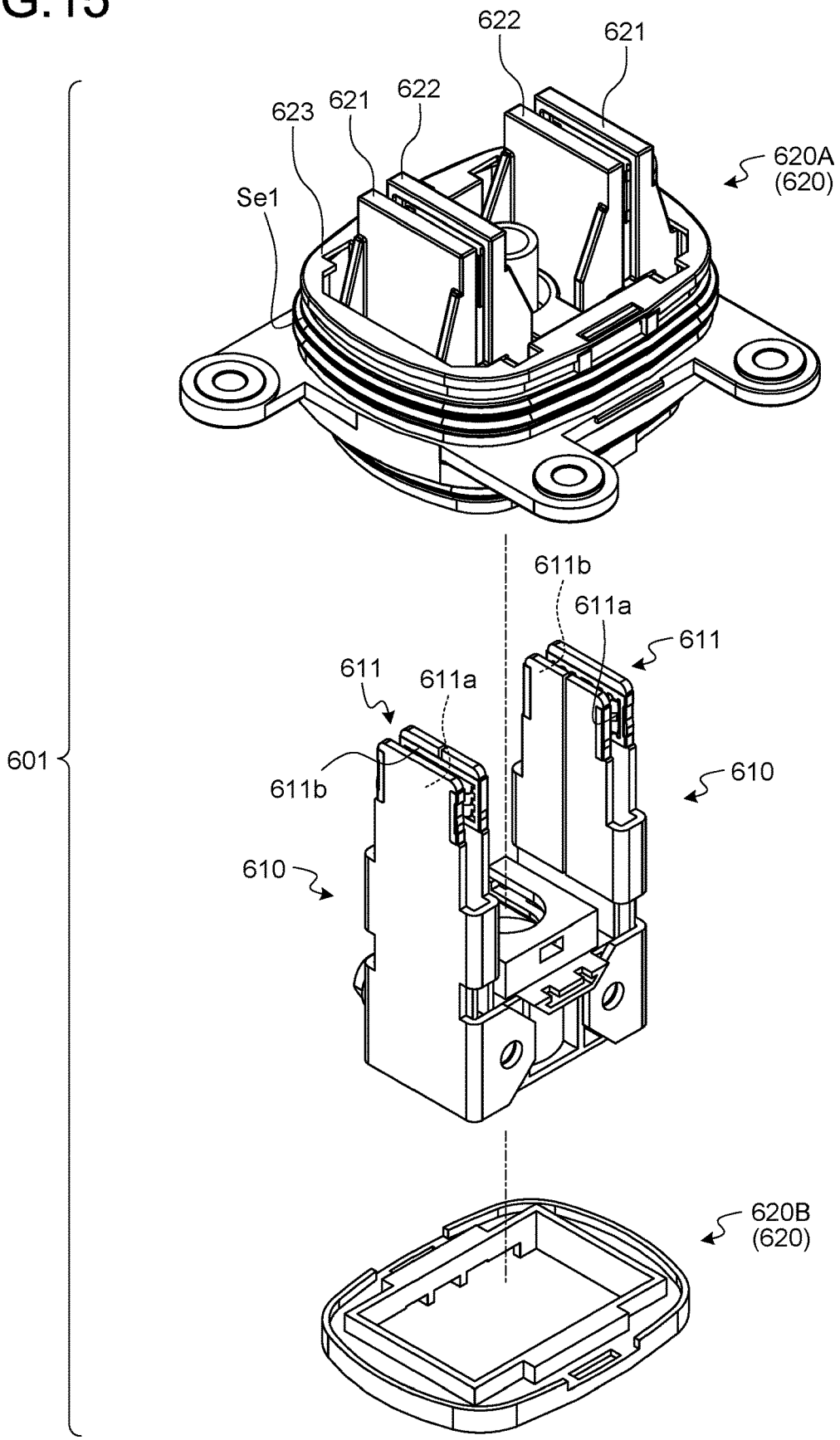
FIG. 15 is an exploded perspective view illustrating the mating connector.

The mating connector 601 includes a mating housing 620 as a component for accommodating the mating connection terminals 610 (FIGS. 11 to 13 and 15). The mating housing 620 is formed of an insulating material such as a synthetic resin. The mating housing 620 has a first contact accommodating portion 621 that accommodates each first contact portion 611*a*, and a second contact accommodating portion 622 that accommodates each second contact portion 611*b* (FIGS. 11 and 15). The first contact accommodating portion 621 and the second contact accommodating portion 622 are arranged opposite to each other with a distance therebetween, and expose therefrom respective contacting portions of the first contact portion 611*a* and the second contact portion 611*b* with the electrical connection portion 11. The mating housing 620 in this example includes an accommodating member 620A and a holding member 620B (FIG. 15). The mating connection terminals 610 accommodated in the accommodating member 620A are held by the holding member 620B.

The electrical connection portion 11 is fitted into the electrical connection portion 611 from one side (excluding the side at the rear end 11*f*) out of the four sides forming the rectangular shape, along a direction orthogonal to this side and along a surface direction of the first wall surface 11*a* and the second wall surface lib. That is, the electrical connection portion 11 can be fitted into the electrical connection portion 611 from one of the end surfaces (the first end surface 11*c*, the second end surface 11*d*) on the two sides along the virtual axis direction and an end surface on the side at the front end 11*e*. For the connector 501 in this example, one of the end surfaces (the first end surface 11*c*, the second end surface 11*d*) on the two sides along the virtual axis direction is directed toward a terminal insertion port 533*b* of a housing 530 described later. Thus, the electrical connection portion 11 is fitted into the electrical connection portion 611 from the end surface on this side.

Respective areas in a direction orthogonal to the virtual axis direction of the electrical connection portion 11 in this example are symmetric to each other with respect to the virtual axis direction. Thus, both the end surfaces (the first end surface 11*c*, the second end surface 11*d*) on the two sides along the virtual axis direction can be directed toward the terminal insertion port 533*b* within the housing 530. This allows the electrical connection portion 11 to be fitted into the electrical connection portion 611 from both the end surfaces (the first end surface 11*c*, the second end surface 11*d*) on the two sides.

The electric wire connection portion 12 may be pressure-bonded by crimping or fixed by welding to the end of the electric wire We. In this example, the electric wire connection portion 12 is fixed to the end of the electric wire We by welding. The electric wire We is pulled out of the electric wire connection portion 12 along the virtual axis direction.

The terminal fitting 10 has two covering target portions 13 to be covered with the covering member 20 at opposite ends in the direction orthogonal to the virtual axis direction of the electrical connection portion 11 (FIGS. 1, 2, 4 to 6, and 8 to 10). The covering target portions 13 are areas capable of being finger-touch prevention targets to be prevented from being touched by the finger(s) of an operator or the like when accommodated within the housing 530 described later. For the electrical connection portion 11 in this example in which both the end surfaces (the first end surface 11*c*, the second end surface 11*d*) on the two sides along the virtual axis direction can be directed toward the terminal insertion port 533*b* as described above, a finger touch on the end surfaces (the first end surface 11*c*, the second end surface 11*d*) on the two sides needs to be prevented. To this end, the covering target portions 13 are individually disposed on the end surfaces (the first end surface 11*c*, the second end surface 11*d*) on the two sides in this example. To be more specific, portions of the two end surfaces (the first end surface 11*c*, the second end surface 11*d*) possibly exposed from the terminal insertion port 533*b* within the housing 530 are set as the covering target portions 13. That is, the covering member 20 is a member used for preventing the electrical connection portion 11 of the terminal fitting 10 from being touched by the finger(s) of an operator or the like when the electrical connection portion 11 is accommodated within the housing 530. Thus, the covering member 20 is formed of an insulating material such as a synthetic resin. In the following, a direction simply referred to as "direction orthogonal to the virtual axis direction" means a direction in which the covering target portions 13 of the first end surface 11*c* and the second end surface 11*d* are arranged opposite to each other.

The covering member 20 has two covering portions (a first covering portion 21, a second covering portion 22) that sandwich and cover, in the direction orthogonal to the virtual axis direction, the two covering target portions 13 disposed at the opposite ends in the orthogonal direction (FIGS. 1, 2, 4 to 6, and 8 to 10). The first covering portion 21 is arranged opposite to the covering target portion 13 of the first end surface 11*c* in a contact state in the direction orthogonal to the virtual axis direction. The second covering portion 22 is arranged opposite to the covering target portion 13 of the second end surface 11*d* in a contact state in the direction orthogonal to the virtual axis direction. The first covering portion 21 and the second covering portion 22 in this example are each formed as a rectangular-parallelepiped arm along the virtual axis direction. The first covering portion 21 and the second covering portion 22 in this example are also each formed such that a thickness in a direction orthogonal to both of an opposing direction of the first covering portion 21 and the second covering portion 22 and the virtual axis direction is equal to or smaller than a thickness of the electrical connection portion 11 (a distance between the first wall surface 11*a* and the second wall surface 11*b*).

Figure 4:
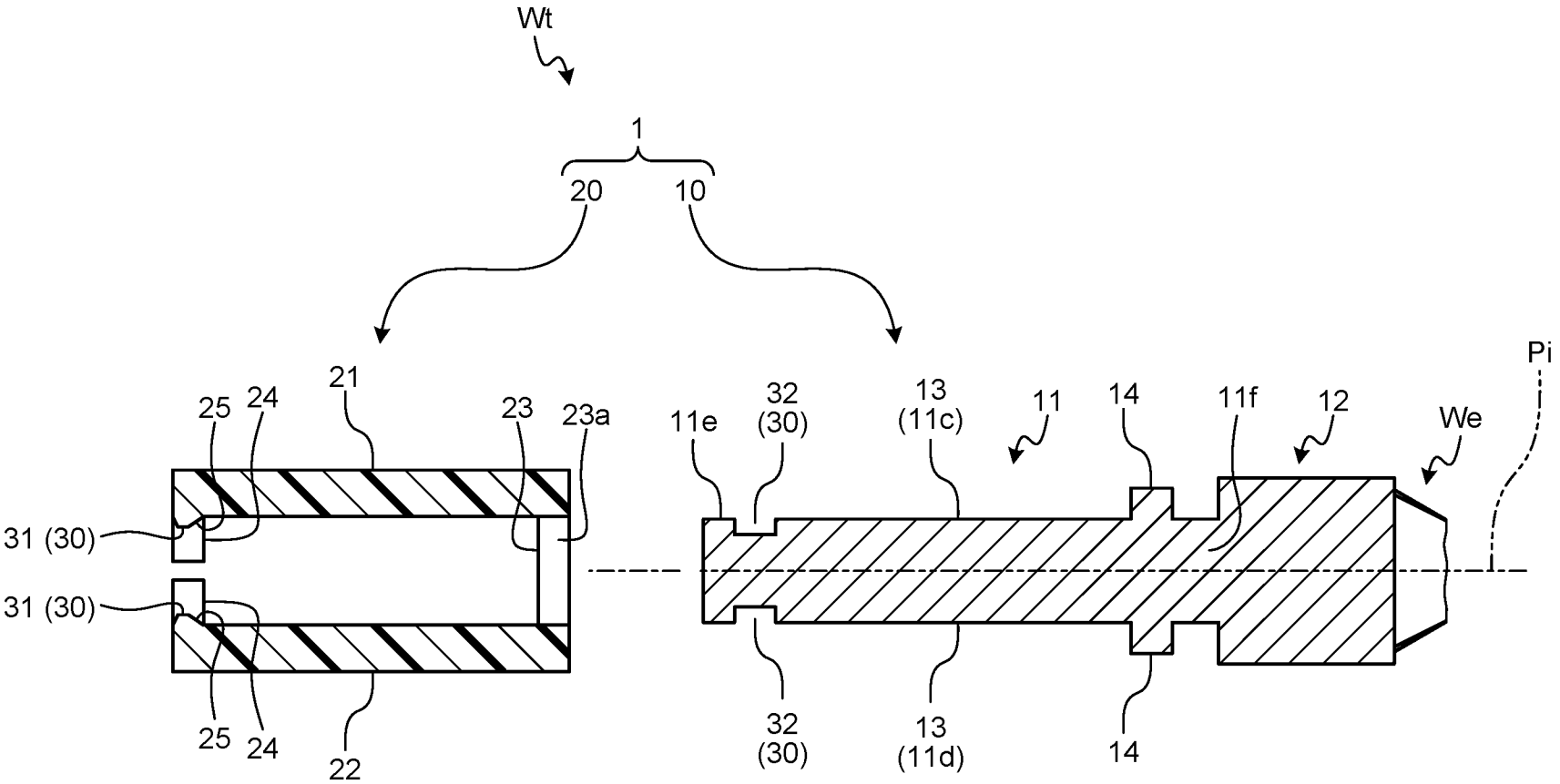
FIG. 4 is a partially enlarged cross-sectional view along an X-X line in FIG. 3.
Figure 5:
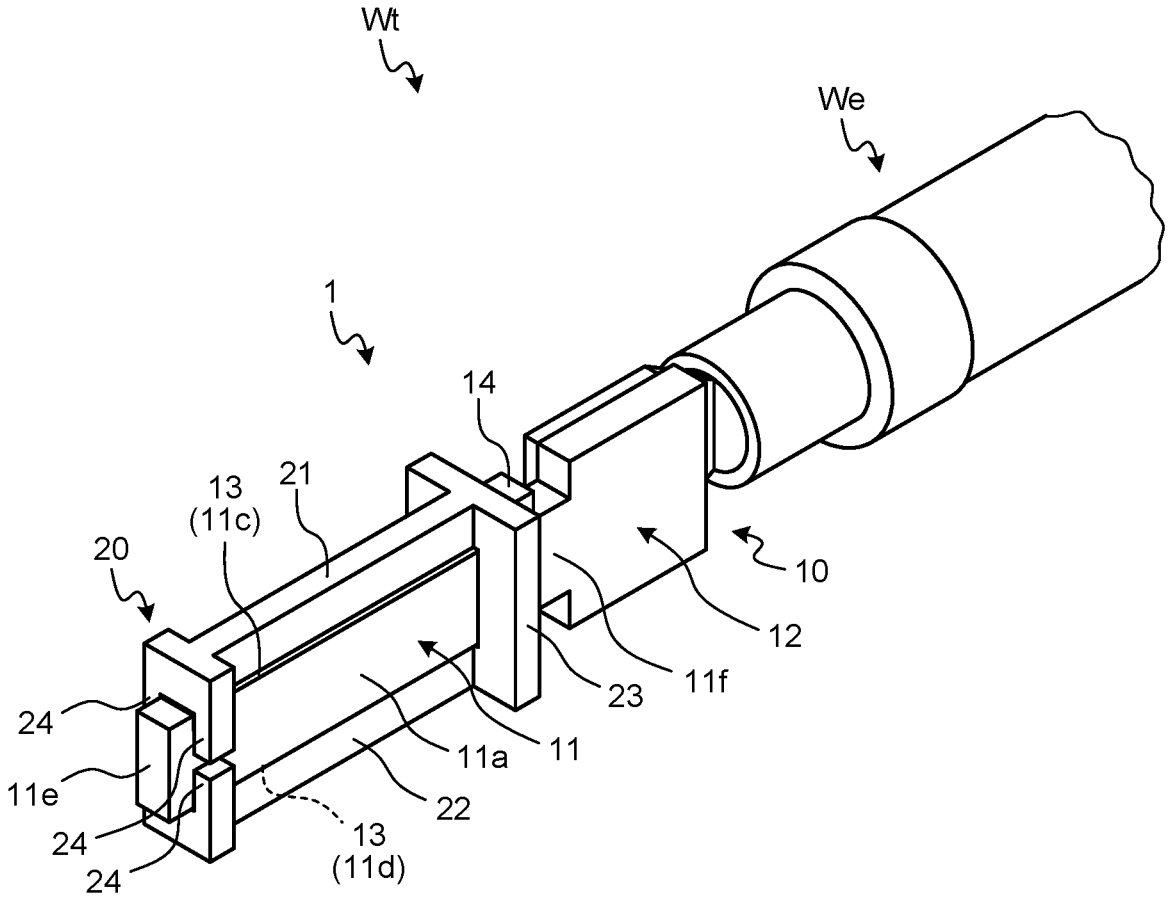
FIG. 5 is a perspective view illustrating the connection terminal and the terminal-equipped electric wire of the embodiment.
Figure 6:
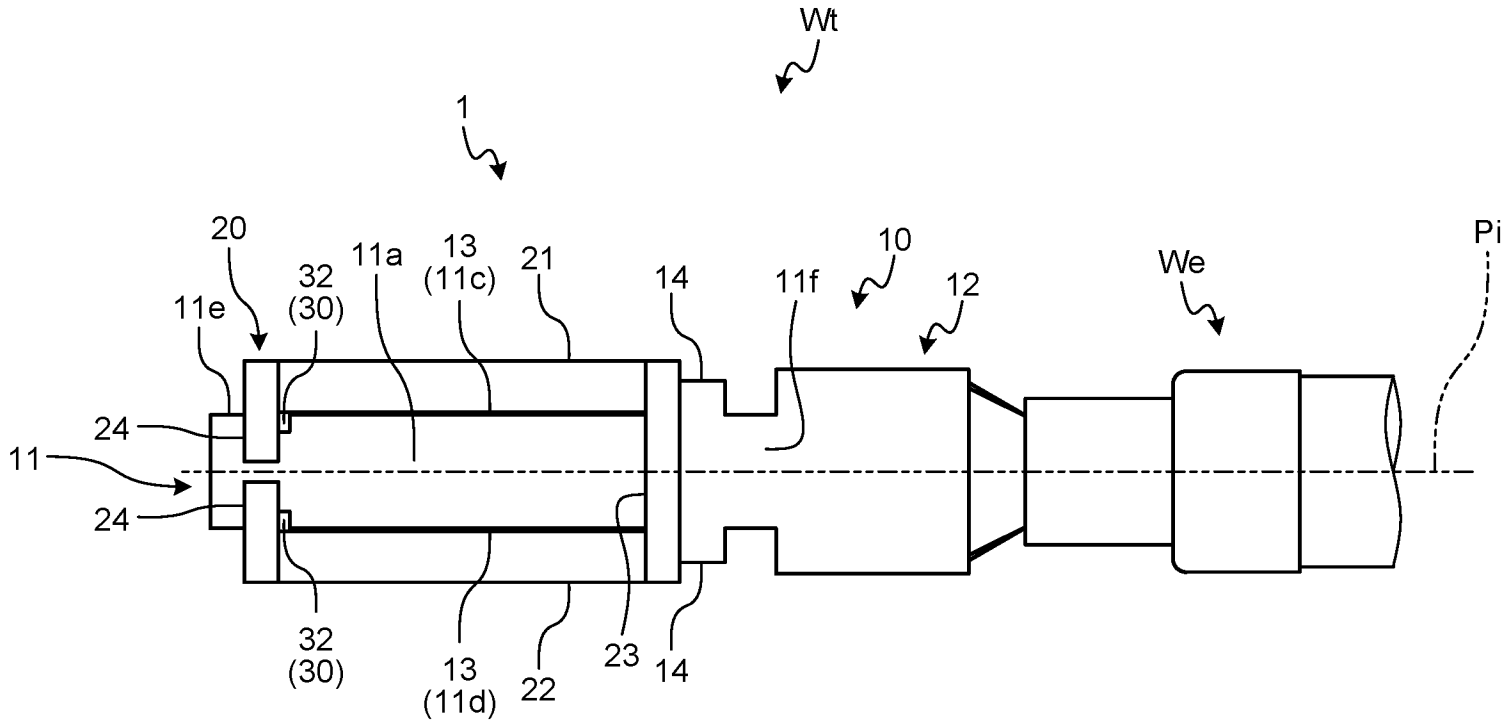
FIG. 6 is a plan view of the connection terminal and the terminal-equipped electric wire of the embodiment as viewed from the contact portion side.
Figure 7:
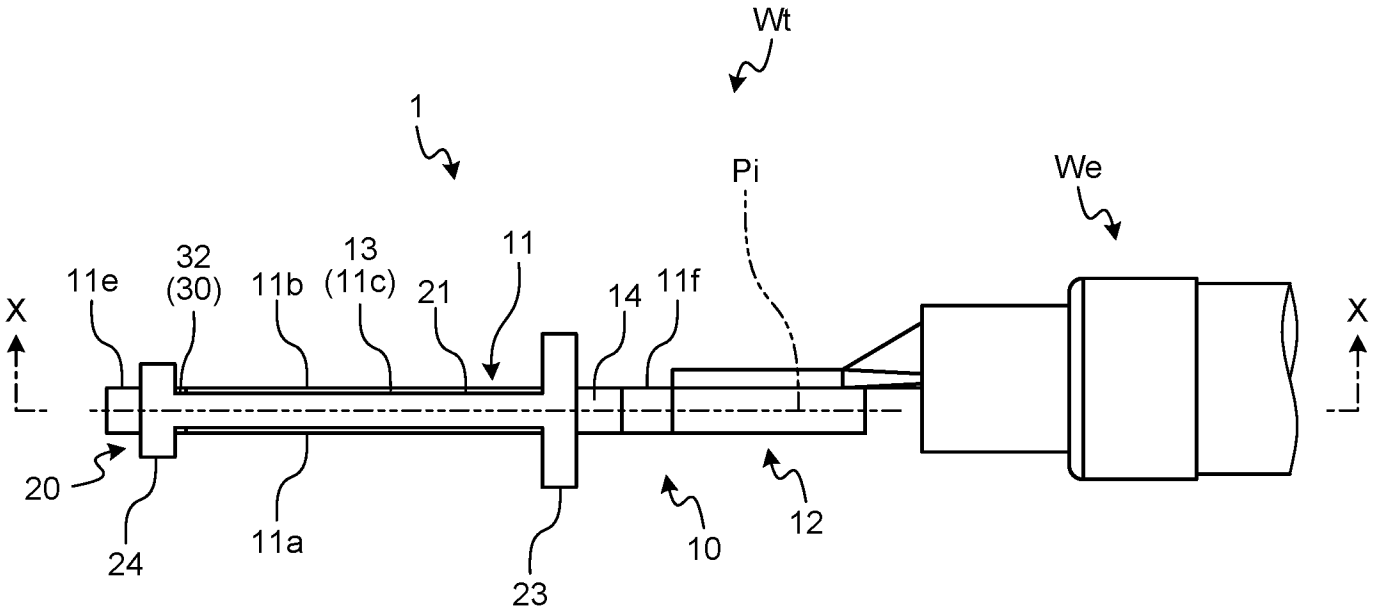
FIG. 7 is a plan view of the connection terminal and the terminal-equipped electric wire of the embodiment as viewed from the covering target portion side.
Figure 8:
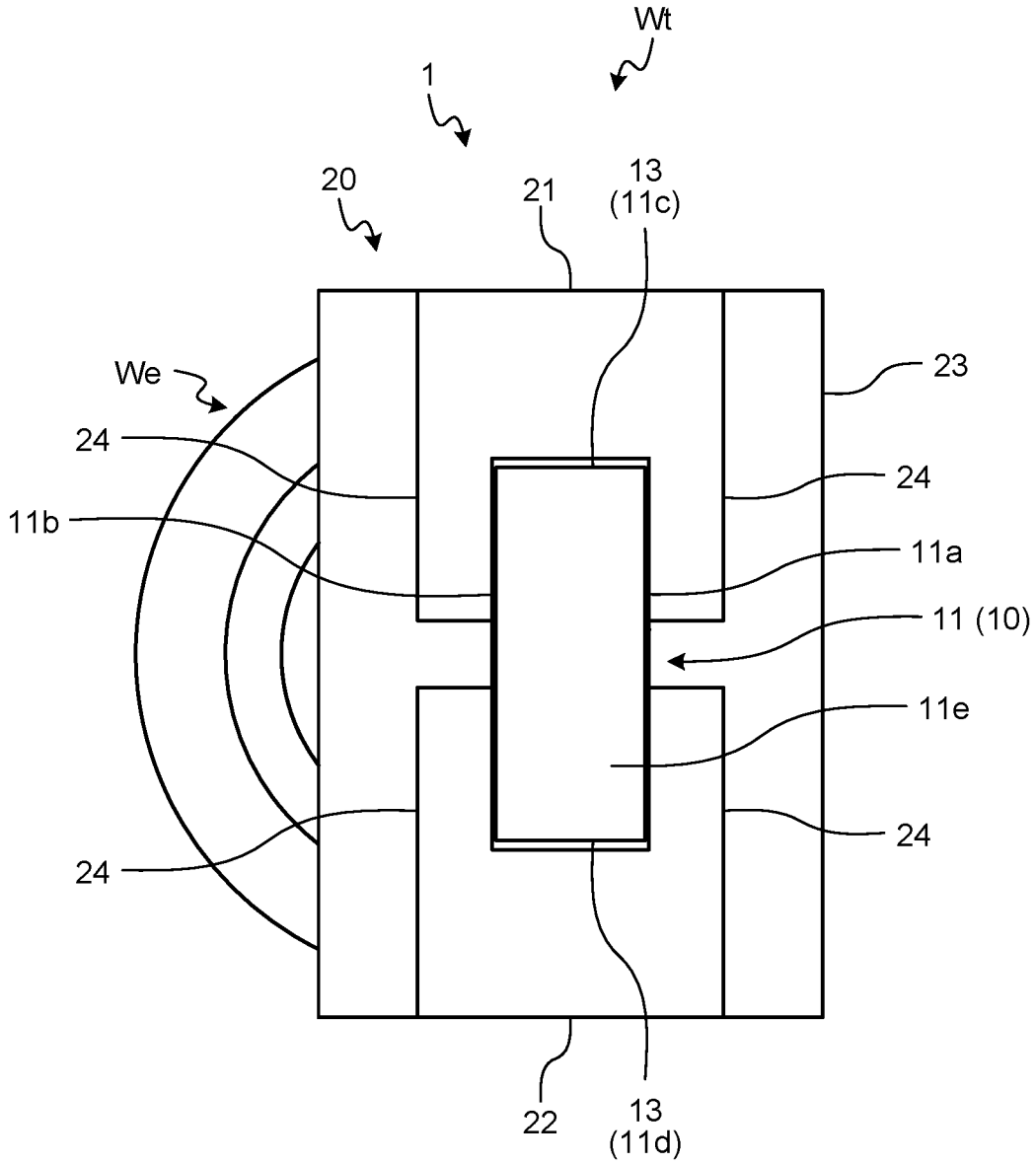
FIG. 8 is a plan view of the connection terminal and the terminal-equipped electric wire of the embodiment as viewed in a virtual axis direction.

The covering member 20 has a coupling portion 23 that couples a first end of the first covering portion 21 and a first end of the second covering portion 22 together (FIGS. 1 to 8). A through hole 23*a* for inserting the electrical connection portion 11 is formed in the coupling portion 23 (FIGS. 1 and 4). The coupling portion 23 in this example is formed in a rectangular plate shape having a flat surface orthogonal to the virtual axis direction. The through hole 23*a* having a rectangular shape is formed in substantially the center of the coupling portion 23. The coupling portion 23 in this example is protruded in the direction orthogonal to both the virtual axis direction and the opposing direction of the first covering portion 21 and the second covering portion 22 from the rectangular through hole 23*a*.

The connection terminal 1 includes a locking structure 30 provided between the terminal fitting 10 and the covering member 20 and configured to undetachably lock the covering member 20 to the terminal fitting 10 (FIGS. 1, 4, 9, and 10). The locking structure 30 includes, for each of combinations of the covering target portions and the covering portions arranged opposite to each other in the direction orthogonal to the virtual axis direction, a locking protrusion 31 provided in one of the covering target portion and the covering portion, and a locking groove 32 provided in the other of the covering target portion and the covering portion and configured to lock the locking protrusion 31 in the virtual axis direction when the locking protrusion 31 is inserted thereinto. In this example, the locking protrusion 31 is provided in each of the first covering portion 21 and the second covering portion 22, and the locking groove 32 in each of the covering target portions 13 of the first end surface 11*c* and the second end surface 11*d*. The respective locking protrusions 31 are arranged opposite to each other in the opposing direction of the first covering portion 21 and the second covering portion 22. The respective locking grooves 32 are formed corresponding to the positions of the respective locking protrusions 31. The pair of each locking protrusion 31 and each locking groove 32 is formed in such a shape as to enable insertion and removal.

The locking protrusion 31 of the first covering portion 21 is protruded from a second end thereof toward a second end of the second covering portion 22 (FIGS. 1, 4, 9, and 10). A cutout is formed close to the front end 11*e* of the electrical connection portion 11 in the covering target portion 13 of the first end surface 11*c*. The cutout is used as the locking groove 32 (FIGS. 1 to 4, 6, 7, 9, and 10). The first covering portion 21 has such flexibility as to enable elastic deformation along a lock release direction for releasing a lock state between the locking protrusion 31 and the locking groove 32 for the first covering portion 21. An elastic deformation shape of the first covering portion 21 along the lock release direction is, in other words, an elastic deformation shape of the first covering portion 21 required in bringing the locking protrusion 31 and the locking groove 32 into the lock state, and is identical with an elastic deformation shape at least immediately before the locking protrusion 31 is inserted into the locking groove 32. For example, the insertion and removal of the pair of the locking protrusion 31 and the locking groove 32 are enabled in the opposing direction of the first covering portion 21 and the covering target portion 13, and in the direction orthogonal to both the opposing direction and the virtual axis direction. In this example, the locking protrusion 31 is inserted into and removed from the locking groove 32 only in the opposing direction of the first covering portion 21 and the covering target portion 13. To this end, the covering member 20 includes a sandwiching piece 24 provided at the second end of the first covering portion 21 so as to sandwich the front end 11*e* of the electrical connection portion 11 from the first wall surface 11*a* and the second wall surface 11*b* (FIGS. 1 to 8). Thus, the pair of the locking protrusion 31 and the locking groove 32 of the locking structure 30 in this example is formed to set the direction orthogonal to the virtual axis direction as the lock release direction.

The second covering portion 22 is formed in a shape symmetric to the first covering portion 21 with respect to the virtual axis Pi, and can be elastically deformed in an opposite direction from the first covering portion 21 with respect to the virtual axis Pi. Thus, the second covering portion 22 can lock the locking protrusion 31 at the second end to the locking groove 32 in the covering target portion 13 of the second end surface 11*d*, and release the lock state similarly to the first covering portion 21. A sandwiching piece 24 is also provided at the second end of the second covering portion 22 so as to sandwich the front end 11*e* of the electrical connection portion 11 from the first wall surface 11*a* and the second wall surface 11*b* similarly to the first covering portion 21 (FIGS. 1 to 8).

Figure 9:
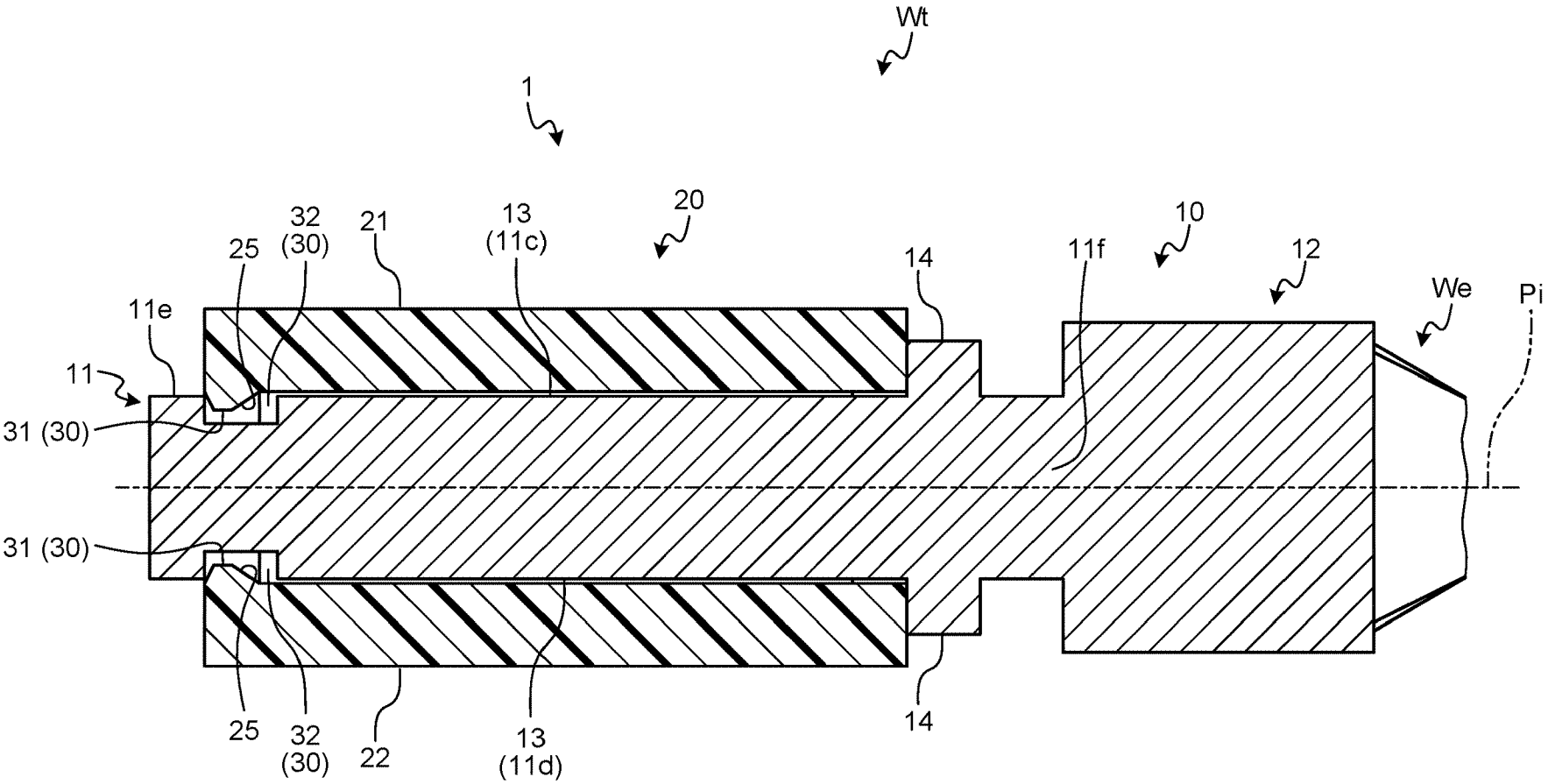
FIG. 9 is a partially enlarged cross-sectional view along an X-X line in FIG. 7.
Figure 10:
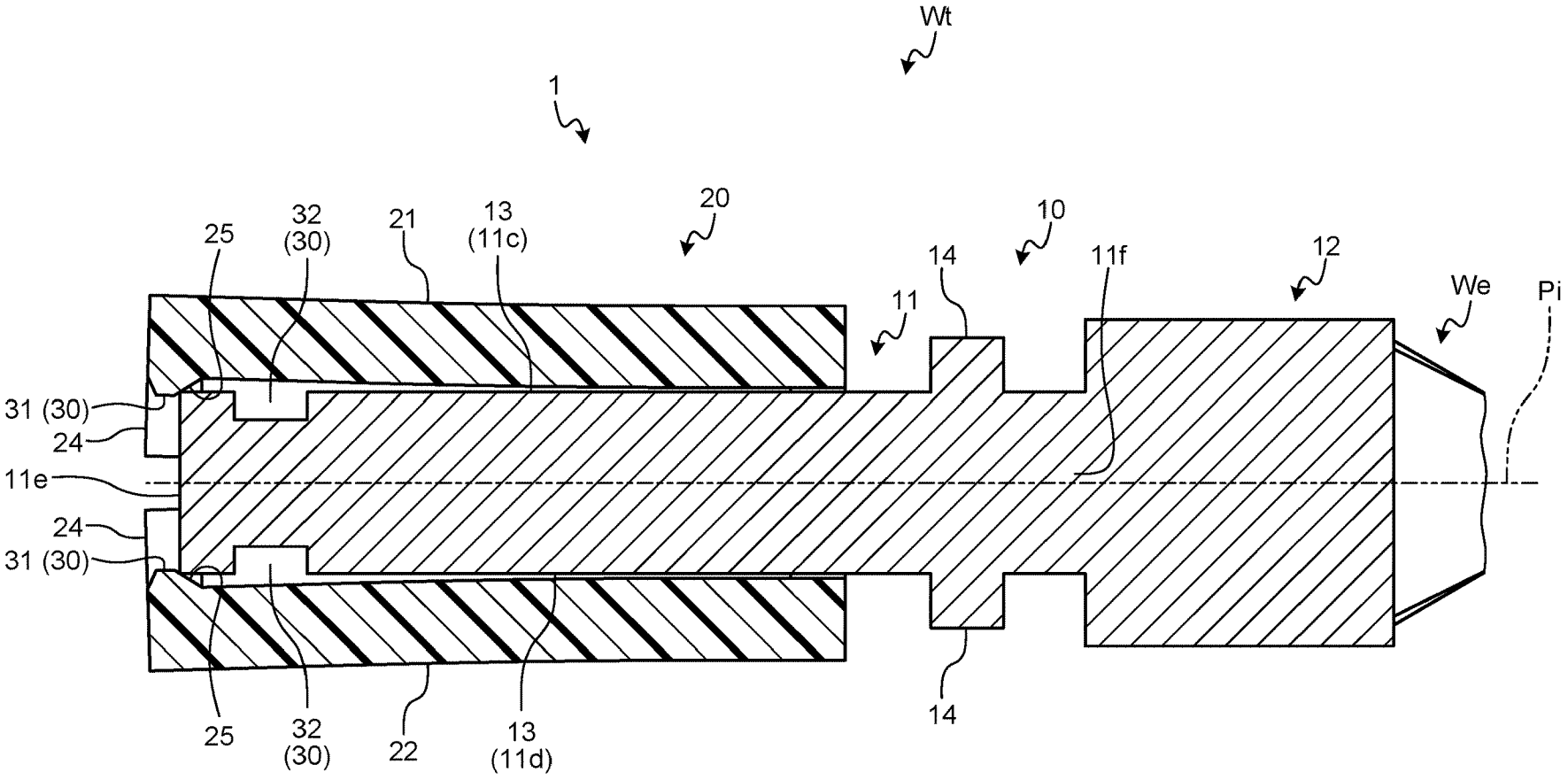
FIG. 10 is a cross-sectional view for explaining a step of attaching a covering member to a terminal fitting.

In the connection terminal 1 and the terminal-equipped electric wire Wt of the present embodiment described above, the terminal fitting 10 is inserted into the through hole 23*a* of the coupling portion 23 of the covering member 20 from the front end 11*e* of the electrical connection portion (FIG. 4). In the connection terminal 1 and the terminal-equipped electric wire Wt, the first covering portion 21 and the second covering portion 22 are elastically deformed and bent in the direction orthogonal to the virtual axis direction (FIG. 10). The first covering portion 21 and the second covering portion 22 are bent to positions where the respective locking protrusions 31 do not lock the side at the front end 11*e* of the electrical connection portion 11. In the connection terminal 1 and the terminal-equipped electric wire Wt, while the first covering portion 21 and the second covering portion 22 are being bent as described above, the respective locking protrusions 31 of the first covering portion 21 and the second covering portion 22 are inserted into the respective locking grooves 32 of the covering target portions 13 of the first end surface 11*c* and the second end surface 11*d* (FIG. 9). In the connection terminal 1 and the terminal-equipped electric wire Wt, with the pair of each locking protrusion 31 and each locking groove 32 brought into the lock state as described above, the covering target portions 13 of the first end surface 11*c* and the second end surface 11*d* are covered with the first covering portion 21 and the second covering portion 22.

In the connection terminal 1 and the terminal-equipped electric wire Wt, for example, an operator elastically deforms and bends the first covering portion 21 and the second covering portion 22, or a jig or the like is used to elastically deform and bend the first covering portion 21 and the second covering portion 22 (FIG. 10). When the coupling portion 23 abuts against positioning protrusions (FIGS. 1 to 7, 9, and 10) individually protruded from the first end surface 11*c* and the second end surface 11*d* in the above state, the bending of the first covering portion 21 and the second covering portion 22 is eliminated. This enables the respective locking protrusions 31 of the first covering portion 21 and the second covering portion 22 to be inserted into the respective locking grooves 32 of the covering target portions 13 of the first end surface 11*c* and the second end surface 11*d* in the connection terminal 1 and the terminal-equipped electric wire Wt (FIG. 9).

The locking protrusion 31 of the first covering portion 21 in this example has an inclined surface 25 that is inclined to a travel direction of the electrical connection portion 11 in attaching the covering member 20 to the terminal fitting 10, along a protruding direction of the locking protrusion 31 with respect to the opposing direction of the first covering portion 21 and the second covering portion 22 (i.e., an insertion and removal direction of the pair of the locking protrusion 31 and the locking groove 32) (FIGS. 4, 9, and 10). The locking protrusion 31 of the second covering portion 22 in this example also has an inclined surface 25 that is inclined to the travel direction of the electrical connection portion 11, along a protruding direction of the locking protrusion 31 with respect to the opposing direction of the first covering portion 21 and the second covering portion 22 (the insertion and removal direction of the pair of the locking protrusion 31 and the locking groove 32) (FIGS. 4, 9, and 10). In the connection terminal 1 and the terminal-equipped electric wire Wt, the electrical connection portion 11 is inserted into the through hole 23*a* of the coupling portion 23 and moved until the front end 11*e* of the electrical connection portion 11 abuts against the inclined surfaces 25 of the respective locking protrusions 31. The respective inclined surfaces 25 convert a force received from the front end 11*e* of the electrical connection portion 11 into a force in the direction to bend the first covering portion 21 and the second covering portion 22. That is, in the connection terminal 1 and the terminal-equipped electric wire Wt, the front end 11*e* of the electrical connection portion 11 elastically deforms and pushes open the first covering portion 21 and the second covering portion 22 while traveling along the inclined surfaces 25 of the respective locking protrusions (FIG. 10). In the connection terminal 1 and the terminal-equipped electric wire Wt, the respective locking protrusions 31 climb on the first end surface 11*c* and the second end surface 11*d* at the front end 11*e*, and then climb over the first end surface 11*c* and the second end surface 11*d* at the front end 11*e* to eliminate the bending of the first covering portion 21 and the second covering portion 22. The respective locking protrusions 31 of the first covering portion 21 and the second covering portion 22 are thereby inserted into the respective locking grooves 32 of the covering target portions 13 of the first end surface 11*c* and the second end surface 11*d* (FIG. 9).

As described above, in the connection terminal 1 and the terminal-equipped electric wire Wt of the present embodiment, each of the first covering portion 21 and the second covering portion 22 of the covering member 20 is provided with one of the locking protrusion 31 and the locking groove 32, and is given flexibility. Thus, the covering member 20 can be attached to the terminal fitting 10 only by inserting the terminal fitting 10 provided with the other of the locking protrusion 31 and the locking groove 32 into the covering member 20. Consequently, the connection terminal 1 and the terminal-equipped electric wire Wt can easily prevent a finger touch on the terminal fitting 10. Additionally, since the connection terminal 1 and the terminal-equipped electric wire Wt of the present embodiment employ such a simple structure, the terminal fitting 10 and the covering member 20 can be made of a variety of materials and formed in a variety of shapes. This also makes it easier to achieve the finger-touch prevention for the terminal fitting 10. Moreover, in the connection terminal 1 and the terminal-equipped electric wire Wt of the present embodiment, it is not necessary to increase the number of steps of forming the shape (the locking grooves 32) used for attaching the covering member 20 in forming the terminal fitting 10. Thus, the connection terminal 1 and the terminal-equipped electric wire Wt have excellent productivity.

Figure 12:
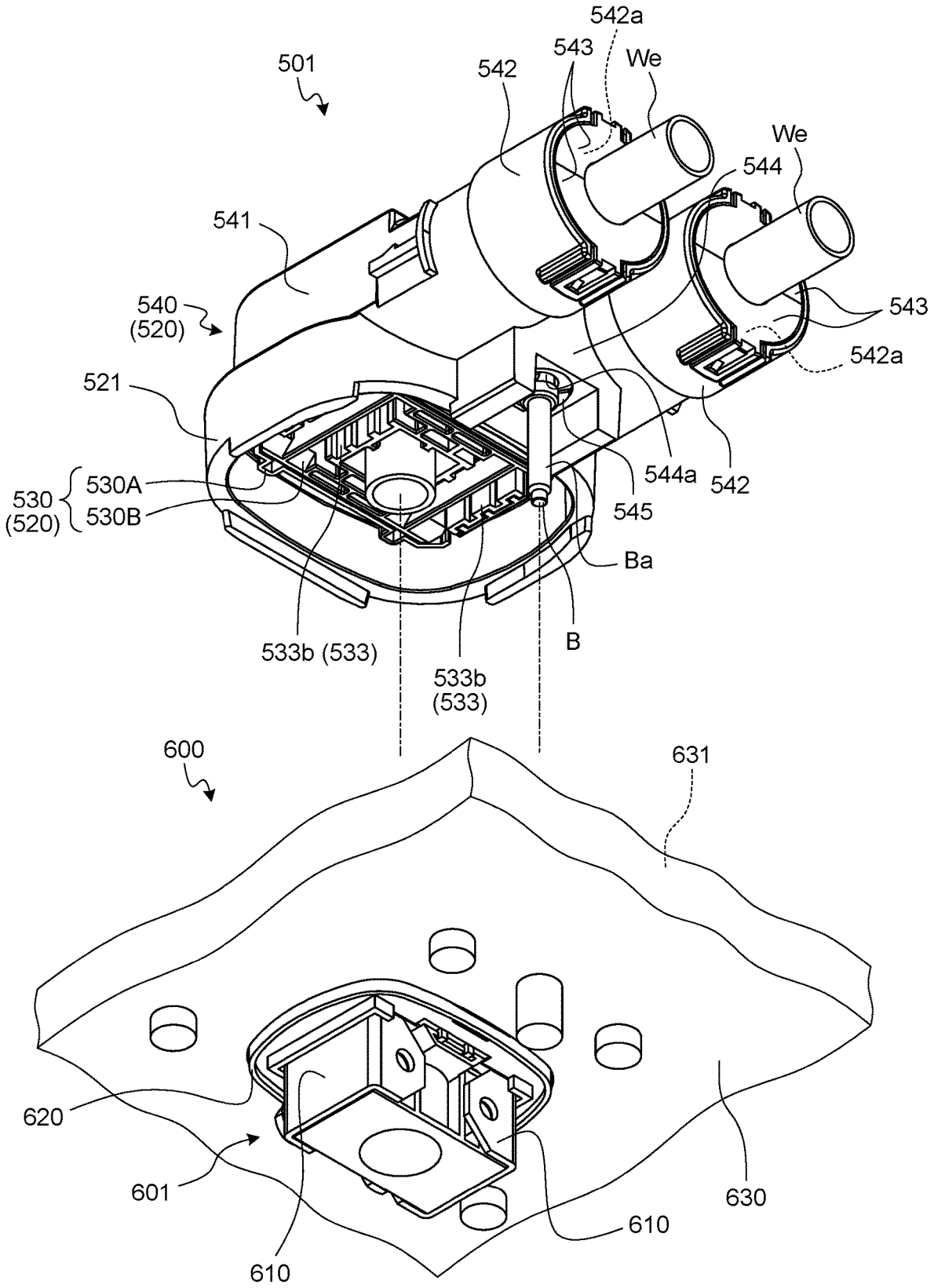
FIG. 12 is a perspective view illustrating from another angle the connector and the mating connector before the fitting connection.
Figure 13:
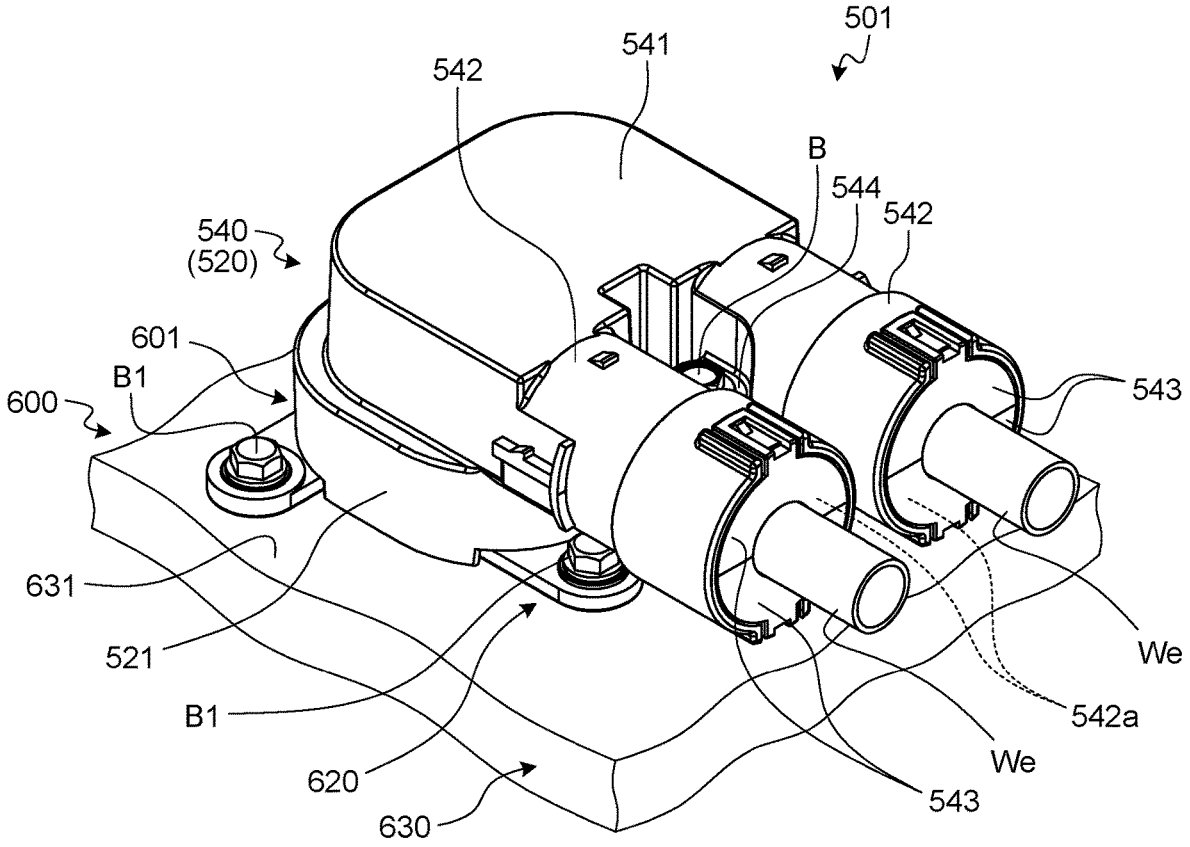
FIG. 13 is a perspective view illustrating the connector and the mating connector after the fitting connection.

The connection terminal 1 and the terminal-equipped electric wire Wt are accommodated in a casing 520 (FIGS. 11 to 14) of the connector 501. The connector 501 is fixed to the mating connector 601 via the casing 520 after connector fitting between the connector 501 and the mating connector 601. The casing 520 of the connector 501 in this example is screwed to a connector fastening wall 631 of the mating connector 601 using a threaded member B (FIGS. 11 to 13). A portion of an outer wall of a case 630 of the mating apparatus 600 is used as the connector fastening wall 631.

The casing 520 has a cylindrical fitting portion 521 to be fitted and connected to a mating fitting portion 623 of the mating housing 620 along a cylinder axis direction (FIGS. 11 to 13). The fitting portion 521 and the mating fitting portion 623 may be formed such that the fitting portion 521 is fitted into an internal space of the mating fitting portion 623, or the mating fitting portion 623 is fitted into an internal space of the fitting portion 521. In any case, the fitting portion 521 is fitted and connected to the mating fitting portion 623 via an annular liquid seal member Se1 (FIG. 11). The liquid seal member Se1 is a seal member such as a gasket for sealing an annular gap formed between the fitting portion 521 and the mating fitting portion 623 after the fitting connection.

In this example, the mating fitting portion 623 is also formed in a cylindrical shape, and is coaxially fitted into the internal space of the fitting portion 521. The mating housing 620 is screwed to the outer wall (the connector fastening wall 631) of the case 630 using male threaded members B1 with the mating fitting portion 623 protruded outward from the outer wall (FIGS. 11 and 13). The liquid seal member Se1 in this example is mounted on an outer circumferential surface of the mating fitting portion 623 coaxially with the mating fitting portion 623. Thus, an inner circumferential surface of the fitting portion 521 in this example is fitted and connected to the outer circumferential surface of the mating fitting portion 623 via the liquid seal member Se1.

Figure 14:
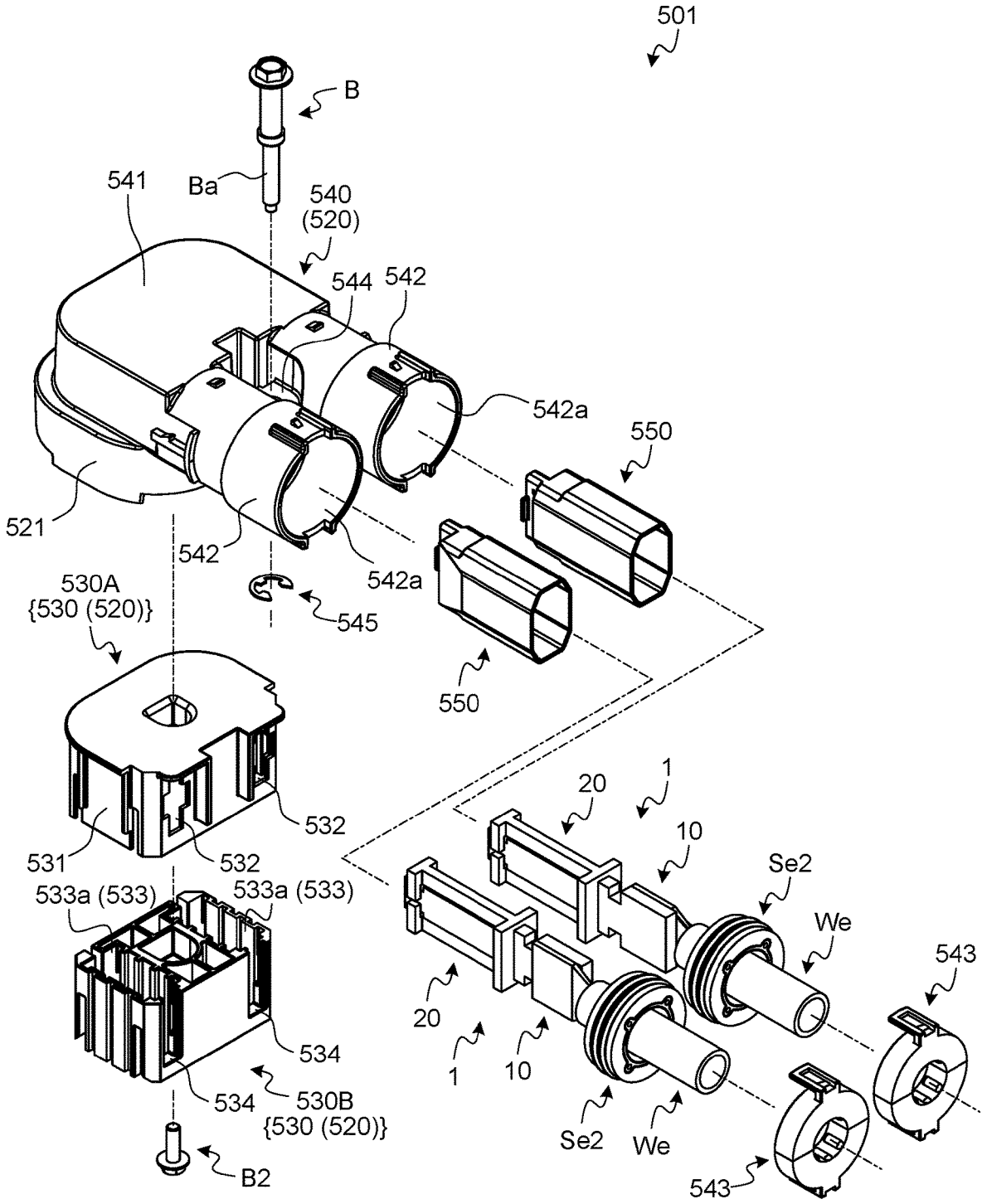
FIG. 14 is an exploded perspective view illustrating the connector.

The casing 520 may be composed only of an insulating housing or may be composed of an insulating housing and a shield shell made of a metal material. The connector 501 in this example is configured as a so-called shield connector capable of preventing noise intrusion from the outside. Thus, the casing 520 in this example includes the insulating housing 530 and a shield shell 540 made of a metal material (FIGS. 12 and 14).

The housing 530 is formed of an insulating material such as a synthetic resin. The housing 530 accommodates at least the connection terminals 1.

The housing 530 may be composed of one component or a plurality of components assembled together. The housing 530 in this example is composed of a first accommodating member 530A and a second accommodating member 530B (FIGS. 12 and 14).

The first accommodating member 530A is formed as a cylindrical body, at least one end of which in a cylinder axis direction is opened. The second accommodating member 530B is inserted into an internal space of the first accommodating member 530A from the opening along the cylinder axis direction. An insertion hole 532 is formed in a cylindrical outer wall 531 of the first accommodating member 530A for each connection terminal 1 so as to insert the connection terminal 1 into the internal space from the front end 11*e* of the electrical connection portion 11 (FIG. 14). The respective connection terminals 1 are inserted from the respective insertion holes 532 in the same direction. The first accommodating member 530A in this example protrudes the electric wire connection portions 12 outward from the insertion holes 532 while accommodating the electrical connection portions 11 and the covering members 20 in the internal space.

The second accommodating member 530B has a terminal accommodating chamber 533 for each connection terminal 1 so as to accommodate the electrical connection portion 11 and the covering member 20 in the internal space of the first accommodating member 530A (FIG. 14). With the second accommodating member 530B inserted into the internal space of the first accommodating member 530A, each electrical connection portion 11 and each covering member 20 accommodated in the internal space of the first accommodating member 530A enter the corresponding terminal accommodating chamber 533 from an opening 533*a* (FIG. 14) to be accommodated therein. Accommodating the second accommodating member 530B in the internal space of the first accommodating member 530A allows the electrical connection portions 11 and the covering members 20 to be accommodated in the terminal accommodating chambers 533. The second accommodating member 530B, which employs such an accommodating form of the electrical connection portions 11 and the covering members 20 in the terminal accommodating chambers 533, has a cutout 534 that is formed continuously from each opening 533*a* and causes each terminal accommodating chamber 533 to communicate with the outside on its outer circumferential surface side (FIG. 14). The electric wire connection portions 12 are protruded to the outside of the second accommodating member 530B from the cutouts 534. The cutouts 534 are arranged opposite to the insertion holes 532 of the first accommodating member 530A in a state in which the second accommodating member 530B is accommodated in the internal space of the first accommodating member 530A so as to protrude the electric wire connection portions 12 outward from the insertion holes 532. Each terminal accommodating chamber 533 of the second accommodating member 530B also has another opening on an opposite side from each opening 533*a*. The opening is used as the terminal insertion port 533*b* used for accommodating the electrical connection portion 611 of the mating connection terminal 610 in the terminal accommodating chamber 533 (FIG. 12). The electrical connection portions 611 are physically and electrically connected to the electrical connection portions 11 within the terminal accommodating chambers 533.

The first accommodating member 530A and the second accommodating member 530B are screwed to the shield shell 540 using a male threaded member B2 (FIG. 14).

The shield shell 540 prevents noise intrusion into the electrical connection portions 11 of the terminal fittings 10 accommodated within the housing 530 by accommodating at least the housing 530 therein. The shield shell 540 in this example prevents noise intrusion into not only the housing 530 but also the electric wire connection portions 12 of the terminal fittings 10 and the ends of the electric wires We pulled out of the housing 530. Thus, the shield shell 540 in this example accommodates therein an area from the housing 530 to the ends of the electric wires We. The shield shell 540 has a main shield body 541 that covers the housing 530 from the outside while exposing the terminal insertion ports 533*b* therefrom, and a sub shield body 542 that covers from the outside each electric wire connection portion 12 and the end of each electric wire We protruded to the outside of the housing 530 from each insertion hole 532 (FIGS. 11 to 14).

The main shield body 541 has a cylindrical shape whose one end in a cylinder axis direction is opened. The housing 530 is accommodated within the main shield body 541 from the opening. The terminal insertion ports 533*b* of the housing 530 are exposed from the opening.

The shield shell 540 has the above fitting portion 521. The rim of the opening of the main shield body 541 is used as the fitting portion 521 in the shield shell 540.

In the shield shell 540, a through hole is formed in an outer circumferential wall of the main shield body 541 so as to be arranged opposite to each insertion hole 532 of the housing 530. The sub shield body 542 is formed so as to close each through hole.

The sub shield bodies 542 are formed in a cylindrical shape whose opposite ends are opened. The sub shield bodies 542 are protruded from the outer circumferential wall of the main shield body 541 such that their cylinder axis directions correspond to a direction orthogonal to the main shield body 541. In the shield shell 540, internal spaces of the main shield body 541 and each sub shield body 542 communicate with each other via the corresponding through hole of the main shield body 541 and one of the openings of the sub shield body 542.

The end of each electric wire We is pulled out from the other opening 542*a* of the corresponding sub shield body 542 (FIGS. 11 to 14).

The sub shield bodies 542 in this example are formed in a cylindrical shape. An annular gap is formed between an inner circumferential surface of each sub shield body 542 and an outer circumferential surface of the end of each electric wire We. An annular liquid seal member Se2 that is a seal member such as a rubber plug to seal the annular gap is provided between the sub shield body 542 and the end of the electric wire We (FIG. 14). The liquid seal members Se2 are mounted on the outer circumferential surfaces of the ends of the electric wires We coaxially with the ends of the electric wires We.

A holding member 543 is mounted on an end close to the opening 542*a* of each sub shield body 542 so as to pull out the end of the corresponding electric wire We and close the opening 542*a* (FIGS. 11 to 14). The holding members 543 are formed of a metal material. Each holding member 543 in this example has a two-divided structure so as to prevent displacement of the liquid seal member Se2 and hold the electric wire We in the center of the sub shield body 542.

For the connector 501, the electric wire connection portions 12 of the terminal fittings 10 are protruded from the insertion holes 532 of the insulating housing 530, and the protruded electric wire connection portions 12 are covered with the conductive sub shield bodies 542 as described above. Thus, the connector 501 increases an insulation distance (a spatial distance and a creepage distance) between each electric wire connection portion 12 and each sub shield body 542 both having conductivity by interposing an insulating body therebetween. The connector 501 includes an insulating cylindrical member (referred to as "insulating cylinder" below) 550 covering each electric wire connection portion 12 and the end of each electric wire We from the outside (FIG. 14). The insulating cylinders 550 are formed of an insulating material such as a synthetic resin. Each insulating cylinder 550 is inserted into the corresponding sub shield body 542, and into the first accommodating member 530A from the corresponding insertion hole 532 on one end side in a cylinder axis direction.

A threaded structure for generating a connector fitting force for connector fitting between the connector 501 and the mating connector 601, and fixing the connector 501 to the mating connector 601 after the connector fitting is provided between the connector 501 and the mating connector 601. The threaded structure uses a threaded portion of the above threaded member B and a mating threaded portion of the mating connector 601.

The threaded member B is arranged opposite to an outer circumferential surface of the fitting portion 521 with a distance therebetween, and is held rotatably about its threaded shaft in the casing 520. The threaded member B generates the connector fitting force in the cylinder axis direction between the fitting portion 521 and the mating fitting portion 623 by using an axial force applied by the threaded portion thereof between the threaded portion and a mating threaded portion 632 (FIG. 11) of the connector fastening wall 631.

One of the threaded portion of the threaded member B and the mating threaded portion 632 is formed as a female threaded portion, and the other as a male threaded portion. For example, when the threaded member B is a female threaded member such as a nut, a male threaded portion such as a stud bolt as the mating threaded portion 632 is protruded from the connector fastening wall 631. In this example, the threaded member B is formed as a male threaded member such as a bolt. Thus, a female threaded portion as the mating threaded portion 632 is formed in the connector fastening wall 631.

The threaded member B is attached to the shield shell 540. The threaded member B in this example is placed between the two sub shield bodies 542 such that a fitting connection direction of the fitting portion 521 to the mating fitting portion 623 corresponds to an axial direction of the threaded shaft. The shield shell 540 has a coupling body 544 that couples the two sub shield bodies 542 between the two sub shield bodies 542 (FIGS. 11 to 14). The coupling body 544 is disposed with a distance from an outer circumferential surface of the main shield body 541. The coupling body 544 has a through hole 544*a* along the fitting connection direction of the fitting portion 521 to the mating fitting portion 623 (FIG. 12). The threaded member B is inserted through the through hole 544*a*. The coupling body 544 holds the threaded member B in the through hole 544*a* in the inserted state by locking a head of the threaded member B to one end in a hole axis direction of the through hole 544*a*, and locking the threaded member B to the other end in the hole axis direction of the through hole 544*a* using a locking member 545 (FIGS. 12 and 14). In this example, a shaft snap ring is used as the locking member 545.

The connector 501 includes the connection terminal 1 and the terminal-equipped electric wire Wt as described above, and thus can provide effects similar to those obtained by the connection terminal 1 and the terminal-equipped electric wire Wt.

Modification

Reference numeral 2 in FIGS. 16 to 27 denotes a connection terminal of the present modification. The connection terminal 2 is physically and electrically connected to the electric wire We to constitute the terminal-equipped electric wire Wt of the present modification. The connection terminal 2 and the terminal-equipped electric wire Wt of the present modification can be substituted for the connection terminal 1 and the terminal-equipped electric wire Wt of the above embodiment to be applied to the connector 501 of the embodiment.

The connection terminal 2 of the present modification includes a terminal fitting 110 and an insulating covering member 120 attachable to and detachable from the terminal fitting 110 from one end in a virtual axis direction of the terminal fitting 110 along the virtual axis direction similarly to the connection terminal 1 of the embodiment (FIGS. 16 to 27).

The terminal fitting 110 of the present modification is formed of a conductive material such as a metal material so as to have a configuration similar to the terminal fitting 10 of the embodiment. Thus, the terminal fitting 110 has an electrical connection portion 111 and an electric wire connection portion 112 similar to the electrical connection portion 11 and the electric wire connection portion 12 of the terminal fitting 10 of the embodiment (FIGS. 16 to 27).

The electrical connection portion 111 is also formed in a rectangular plate shape in the present modification. The virtual axis Pi is set to extend along two flat surfaces (a first wall surface 111*a*, a second wall surface 111*b*) used as contact portions in the center between these flat surfaces and along an extension direction of end surfaces (a first end surface 111*c*, a second end surface 111*d*) on two sides in the center between these end surfaces (FIGS. 17 to 19, 21, 22, and 24 to 27). The covering member 120 is attached and detached from a side at a front end 111*e* of the electrical connection portion 111. The electric wire connection portion 112 is disposed on a side at a rear end 111*f* of the electrical connection portion 111.

The terminal fitting 110 has two covering target portions (referred to as "first covering target portions" below) 113 to be covered with the covering member 120 at opposite ends in a direction orthogonal to the virtual axis direction of the electrical connection portion 111 (FIGS. 16 to 18 and 20 to 23). The first covering target portions 113 of the present modification are individually disposed on the end surfaces (the first end surface 111*c*, the second end surface 111*d*) on the two sides along the virtual axis direction similarly to the terminal fitting 10 of the embodiment.

When a connector as disclosed in Japanese Patent Application Laid-open No. 2019-3744 is used, the terminal fitting 110 is fitted into a mating connection terminal from the front end 111*e*. In this case, a finger touch on the front end 111*e* needs to be prevented. To this end, an end surface at one end in the virtual axis direction (i.e., the front end 111*e*) of the electrical connection portion 111 is also set as a covering target portion (referred to as "second covering target portion" below) 111$e_1$ in the terminal fitting 110 of the present modification (FIGS. 16 to 19, 21, and 24 to 27). That is, the connection terminal 2 of the present modification can be applied to not only the connector 501 of the embodiment, but also the connector disclosed in Japanese Patent Application Laid-open No. 2019-3744.

The covering member 120 of the present modification has two main covering portions (a first main covering portion 121, a second main covering portion 122) that sandwich and cover, in the direction orthogonal to the virtual axis direction, the two first covering target portions 113 disposed at the opposite ends in the orthogonal direction similarly to the covering member 20 of the embodiment (FIGS. 16, 17, 20 to 21, and 23). The first main covering portion 121 is arranged opposite to the first covering target portion 113 of the first end surface 111*c* in a contact state in the direction orthogonal to the virtual axis direction. The second main covering portion 122 is arranged opposite to the first covering target portion 113 of the second end surface 111*d* in a contact state in the direction orthogonal to the virtual axis direction. The first main covering portion 121 and the second main covering portion 122 in this example are each formed as a rectangular-parallelepiped arm along the virtual axis direction. The first main covering portion 121 and the second main covering portion 122 in this example are also each formed such that a thickness in a direction orthogonal to both of an opposing direction of the first main covering portion 121 and the second main covering portion 122 and the virtual axis direction is equal to or smaller than a thickness of the electrical connection portion 111 (a distance between the first wall surface 111*a* and the second wall surface 111*b*).

The covering member 120 of the present modification further has a sub covering portion 123 that covers the end surface at one end in the virtual axis direction (i.e., the second covering target portion 111$e_1$ at the front end 111*e*) of the terminal fitting 110 (FIGS. 16 to 27). The sub covering portion 123 is coupled to a first end of the first main covering portion 121 and a first end of the second main covering portion 122. The sub covering portion 123 is arranged opposite to the second covering target portion 111$e_1$ at the front end 111*e* of the electrical connection portion 111 in a contact state in the virtual axis direction. The sub covering portion 123 in this example is formed in a rectangular plate shape. An end surface on one side in the virtual axis direction out of the four sides is arranged opposite to the second covering target portion 111$e_1$ in a contact state. The sub covering portion 123 in this example is also formed such that a thickness in the direction orthogonal to both the virtual axis direction and the opposing direction of the first main covering portion 121 and the second main covering portion 122 is equal to or smaller than the thickness of the electrical connection portion 111 (the distance between the first wall surface 111*a* and the second wall surface 111*b*).

Figure 16:
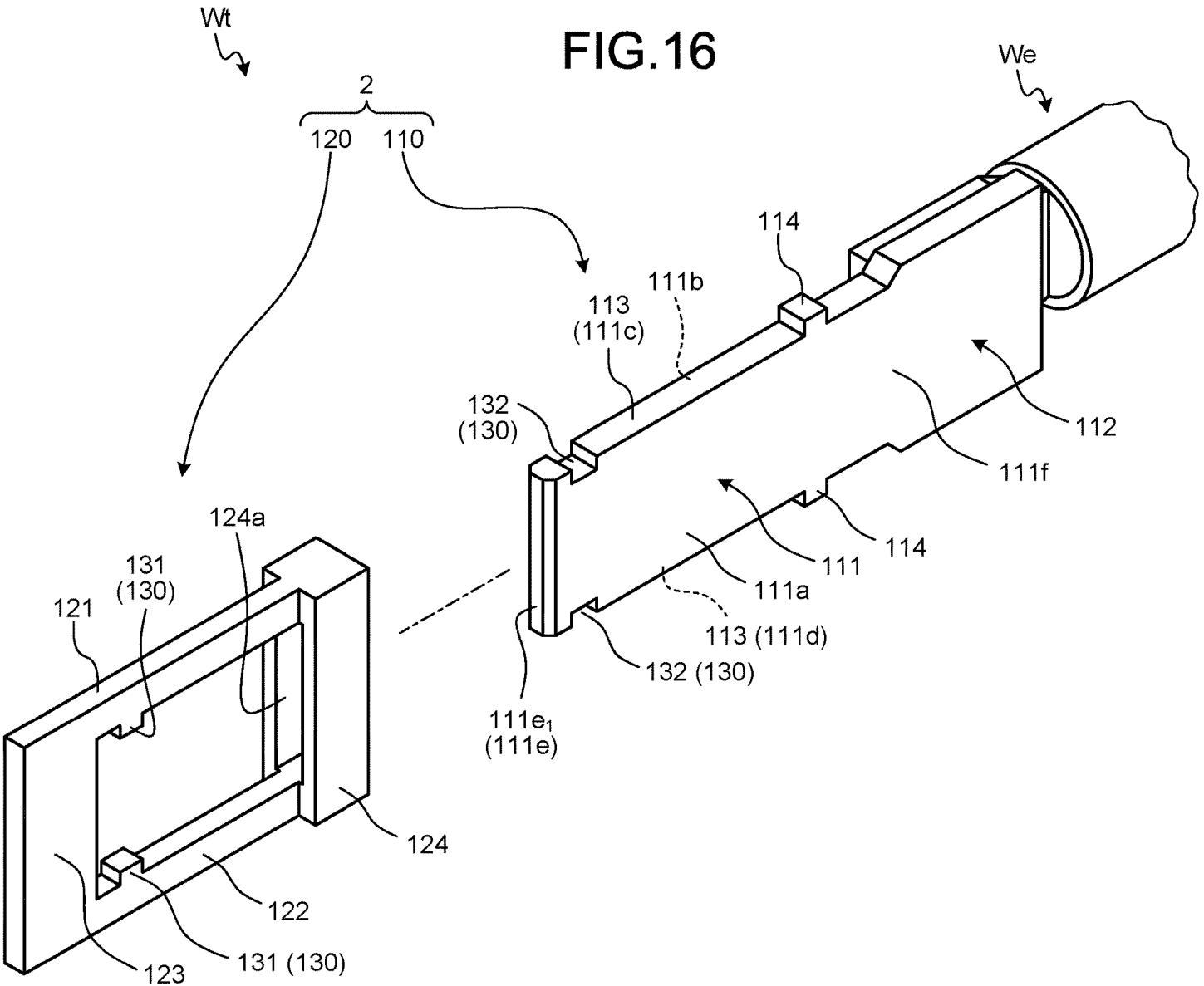
FIG. 16 is an exploded perspective view illustrating a connection terminal and a terminal-equipped electric wire of a modification.
Figure 17:
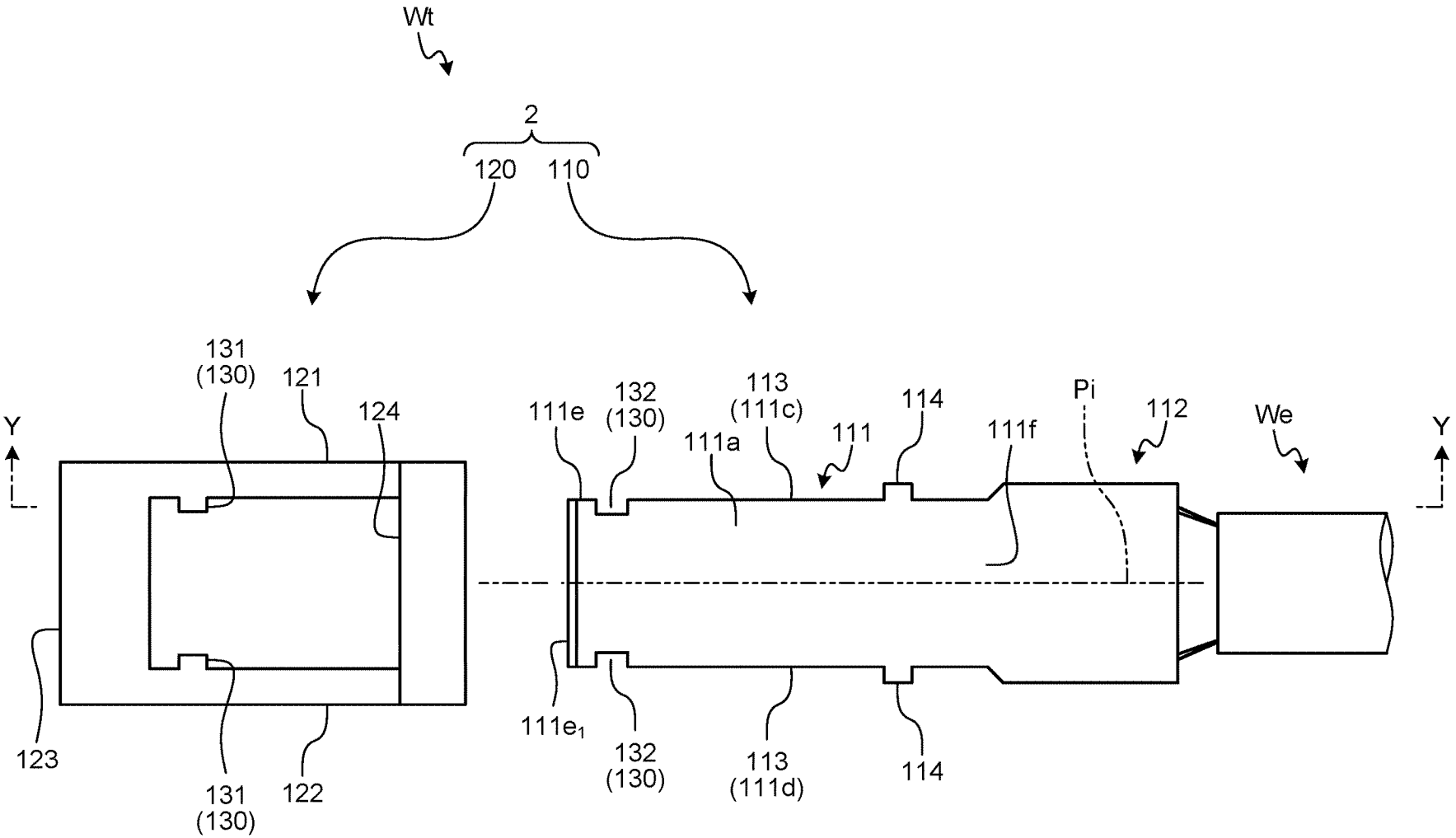
FIG. 17 is an exploded plan view of the connection terminal and the terminal-equipped electric wire of the modification as viewed from a contact portion side.
Figure 18:
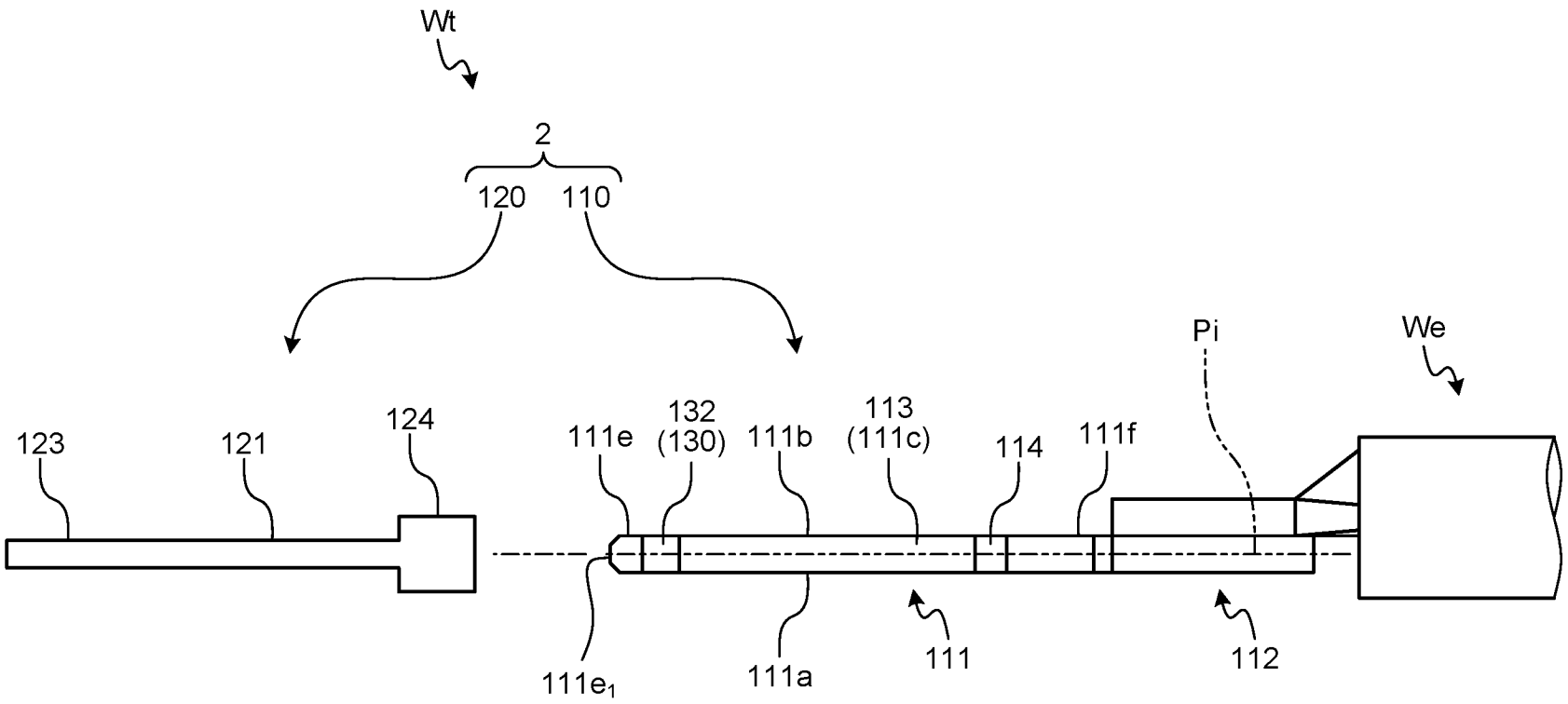
FIG. 18 is an exploded plan view of the connection terminal and the terminal-equipped electric wire of the modification as viewed from a covering target portion side.
Figure 19:
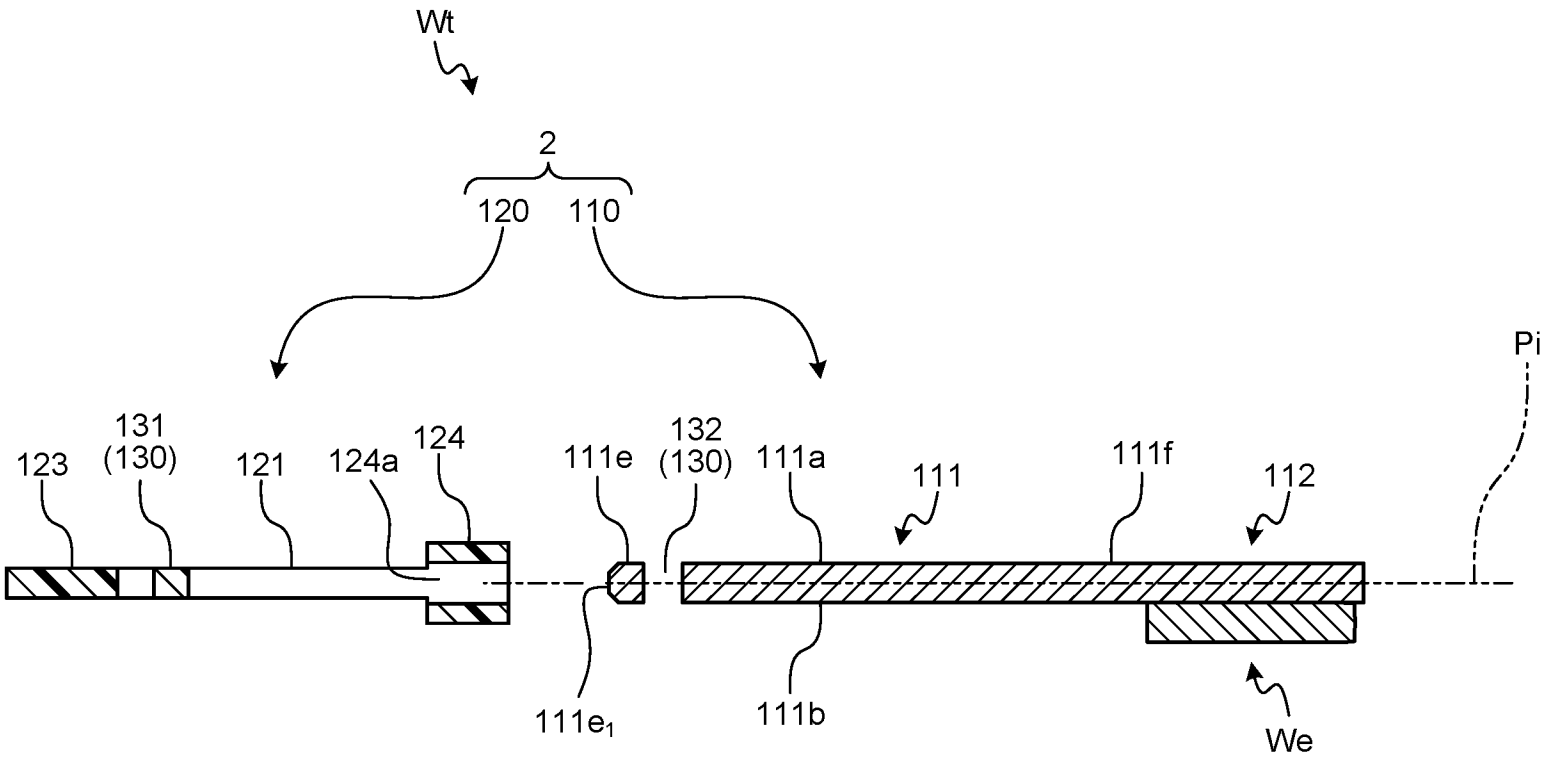
FIG. 19 is a cross-sectional view along a Y-Y line in FIG. 17.
Figure 20:
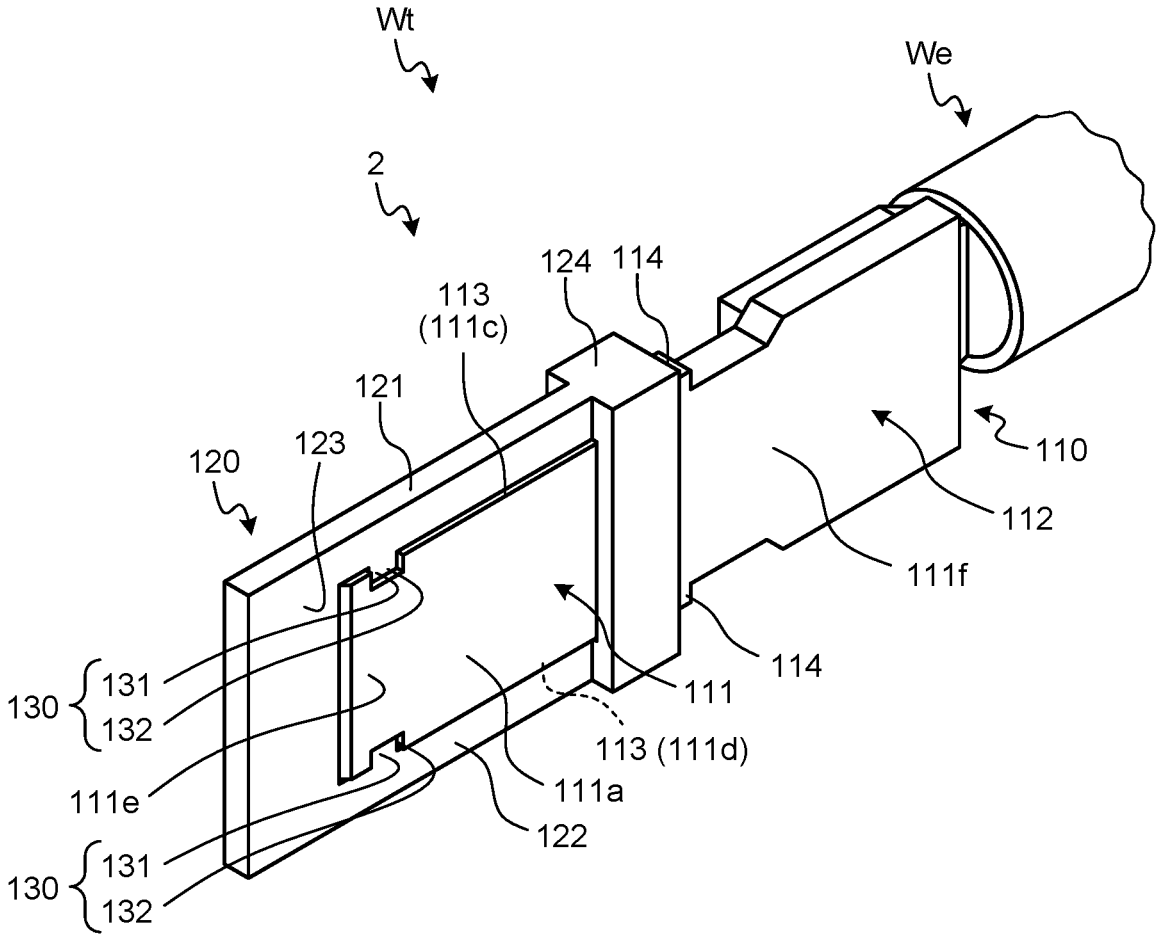
FIG. 20 is a perspective view illustrating the connection terminal and the terminal-equipped electric wire of the modification.
Figure 21:
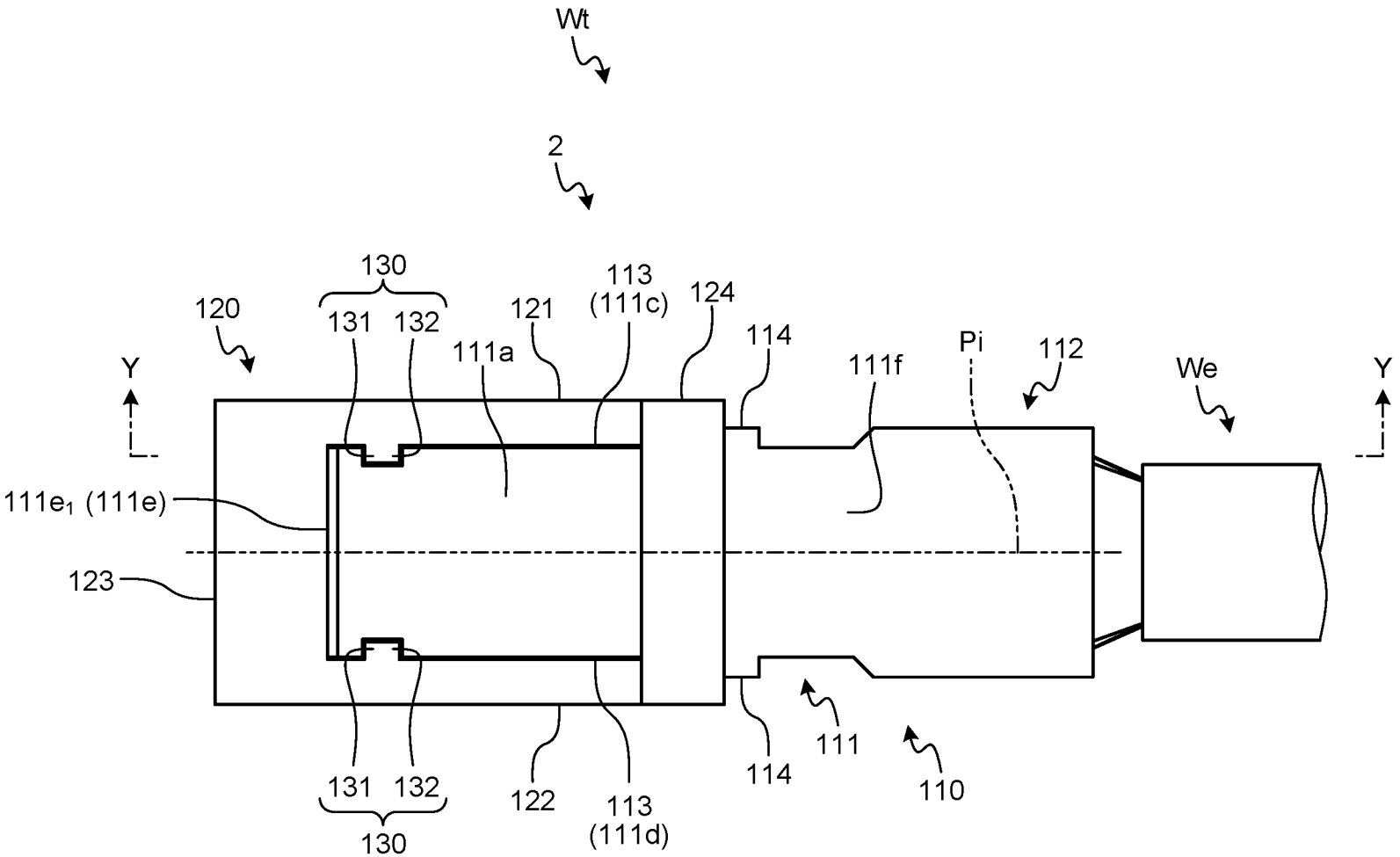
FIG. 21 is a plan view of the connection terminal and the terminal-equipped electric wire of the modification as viewed from the contact portion side.
Figure 22:
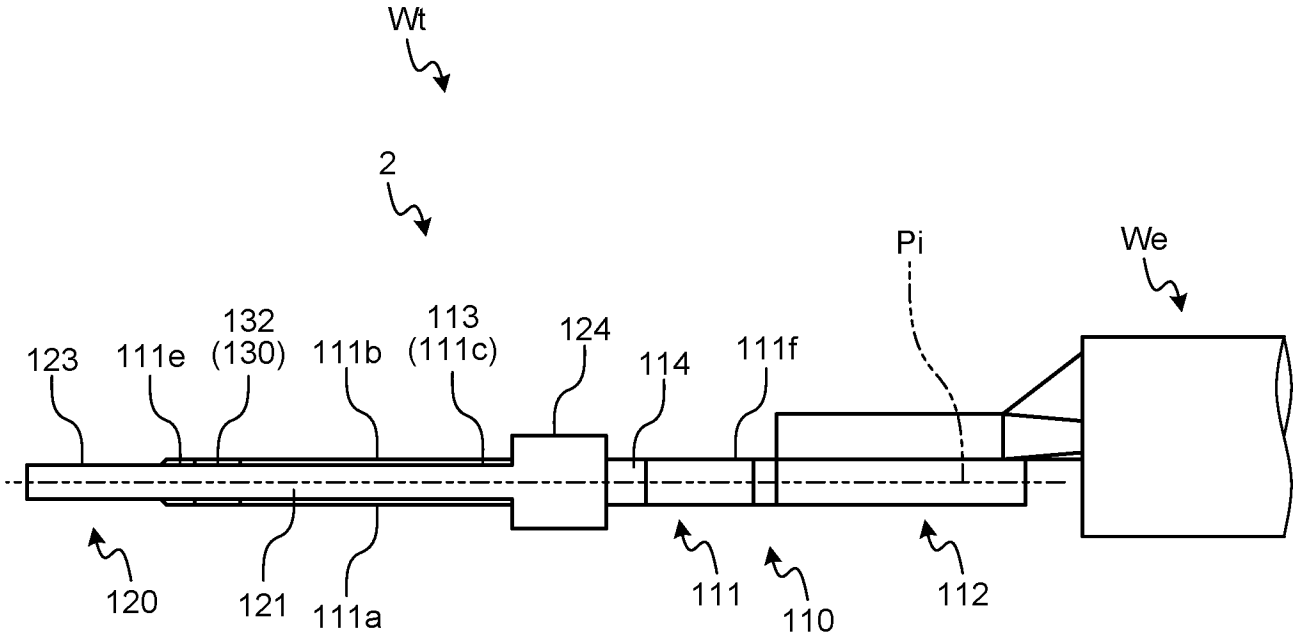
FIG. 22 is a plan view of the connection terminal and the terminal-equipped electric wire of the modification as viewed from the covering target portion side.
Figure 23:
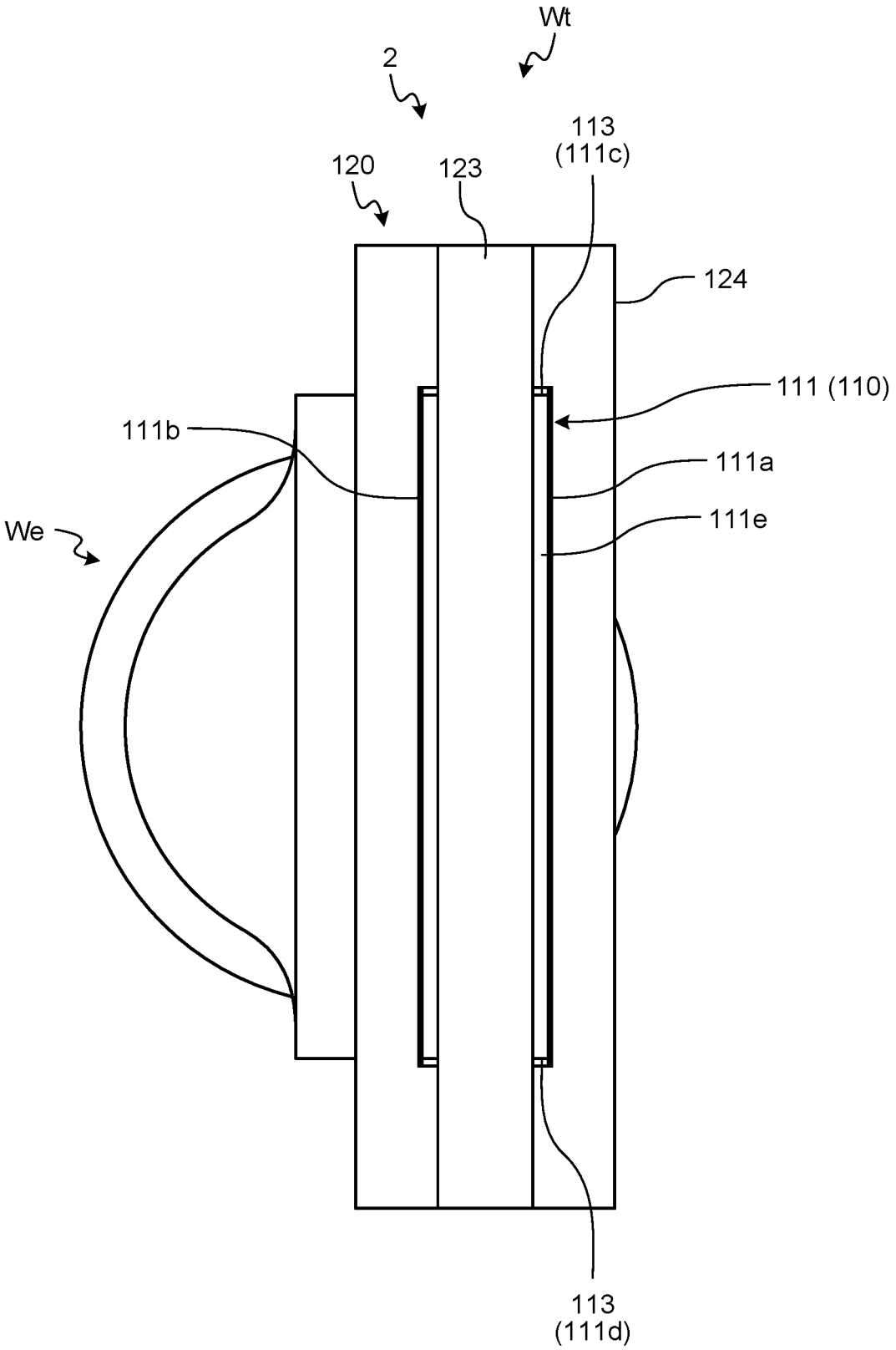
FIG. 23 is a plan view of the connection terminal and the terminal-equipped electric wire of the modification as viewed in a virtual axis direction.

The covering member 120 has a coupling portion 124 that couples a second end of the first main covering portion 121 and a second end of the second main covering portion 122 together (FIGS. 16 to 27). A through hole 124*a* for inserting the electrical connection portion 111 is formed in the coupling portion 124 (FIGS. 16 and 19). The coupling portion 124 in this example is formed in a rectangular parallelepiped shape having a flat surface orthogonal to the virtual axis direction. The through hole 124*a* having a rectangular shape is formed in substantially the center of the coupling portion 124. The coupling portion 124 in this example is protruded in the direction orthogonal to both the virtual axis direction and the opposing direction of the first main covering portion 121 and the second main covering portion 122 from the rectangular through hole 124*a*.

The connection terminal 2 includes a locking structure 130 provided between the terminal fitting 110 and the covering member 120 and configured to undetachably lock the covering member 120 to the terminal fitting 110 (FIGS. 16 to 22 and 24 to 27). The locking structure 130 has a configuration similar to the locking structure 30 of the embodiment, and includes, for each of combinations of the first covering target portions and the main covering portions arranged opposite to each other in the direction orthogonal to the virtual axis direction, a locking protrusion 131 provided in one of the first covering target portion and the main covering portion, and a locking groove 132 provided in the other of the first covering target portion and the main covering portion and configured to lock the locking protrusion 131 in the virtual axis direction when the locking protrusion 131 is inserted thereinto. In the present modification, the locking protrusions 131 are also individually provided in the first main covering portion 121 and the second main covering portion 122, and are arranged opposite to each other in the opposing direction of the first main covering portion 121 and the second main covering portion 122. In the present modification, the locking grooves 32 are also individually provided in the first covering target portions 113 of the first end surface 111*c* and the second end surface 111*d* corresponding to the positions of the respective locking protrusions 131. The pair of each locking protrusion 131 and each locking groove 132 is formed in such a shape as to enable insertion and removal.

The locking protrusion 131 of the first main covering portion 121 is protruded from the first end thereof toward the first end of the second main covering portion 122 (FIGS. 16, 17, and 20 to 21). A cutout is formed close to the front end 111*e* of the electrical connection portion 111 in the first covering target portion 113 of the first end surface 111*c*. The cutout is used as the locking groove 132 (FIGS. 16, 17, and 20 to 21). The first main covering portion 121 has such flexibility as to enable elastic deformation along a lock release direction for releasing a lock state between the locking protrusion 131 and the locking groove 132 for the first main covering portion 121. An elastic deformation shape of the first main covering portion 121 along the lock release direction is, in other words, an elastic deformation shape of the first main covering portion 121 required in bringing the locking protrusion 131 and the locking groove 132 into the lock state, and is identical with an elastic deformation shape at least immediately before the locking protrusion 131 is inserted into the locking groove 132. In the present modification, the locking protrusion 131 is inserted into and removed from the locking groove 132 in the direction orthogonal to both the virtual axis direction and the opposing direction of the first main covering portion 121 and the second main covering portion 122 by using the bending of the first main covering portion 121. Thus, the pair of the locking protrusion 131 and the locking groove 132 of the locking structure 130 of the present modification is formed to set the direction orthogonal to both the virtual axis direction and the opposing direction of the first main covering portion 121 and the second main covering portion 122 as the lock release direction.

The second main covering portion 122 is formed in a shape symmetric to the first main covering portion 121 with respect to the virtual axis Pi, and can be elastically deformed in the same direction as the first main covering portion 121. Thus, the second main covering portion 122 can lock the locking protrusion 131 at the first end to the locking groove 132 in the covering target portion 113 of the second end surface 111*d*, and release the lock state similarly to the first main covering portion 121. Consequently, in the present modification, the locking protrusions 131 can be inserted into and removed from the locking grooves 132 in the direction orthogonal to both the virtual axis direction and the opposing direction of the first main covering portion 121 and the second main covering portion 122 by using the bending of the second main covering portion 122 as well as the bending of the first main covering portion 121.

Figure 24:
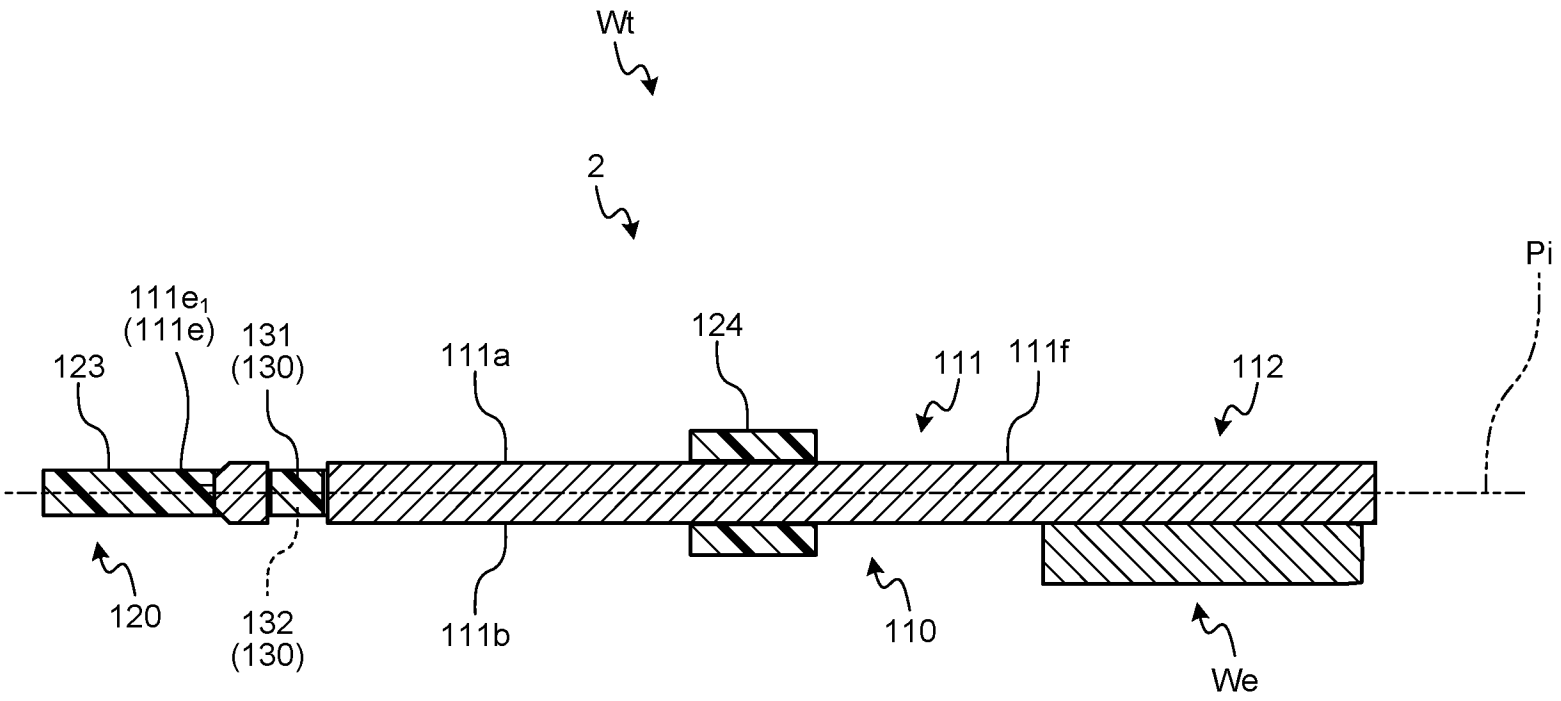
FIG. 24 is a cross-sectional view along a Y-Y line in FIG. 21.
Figure 25:
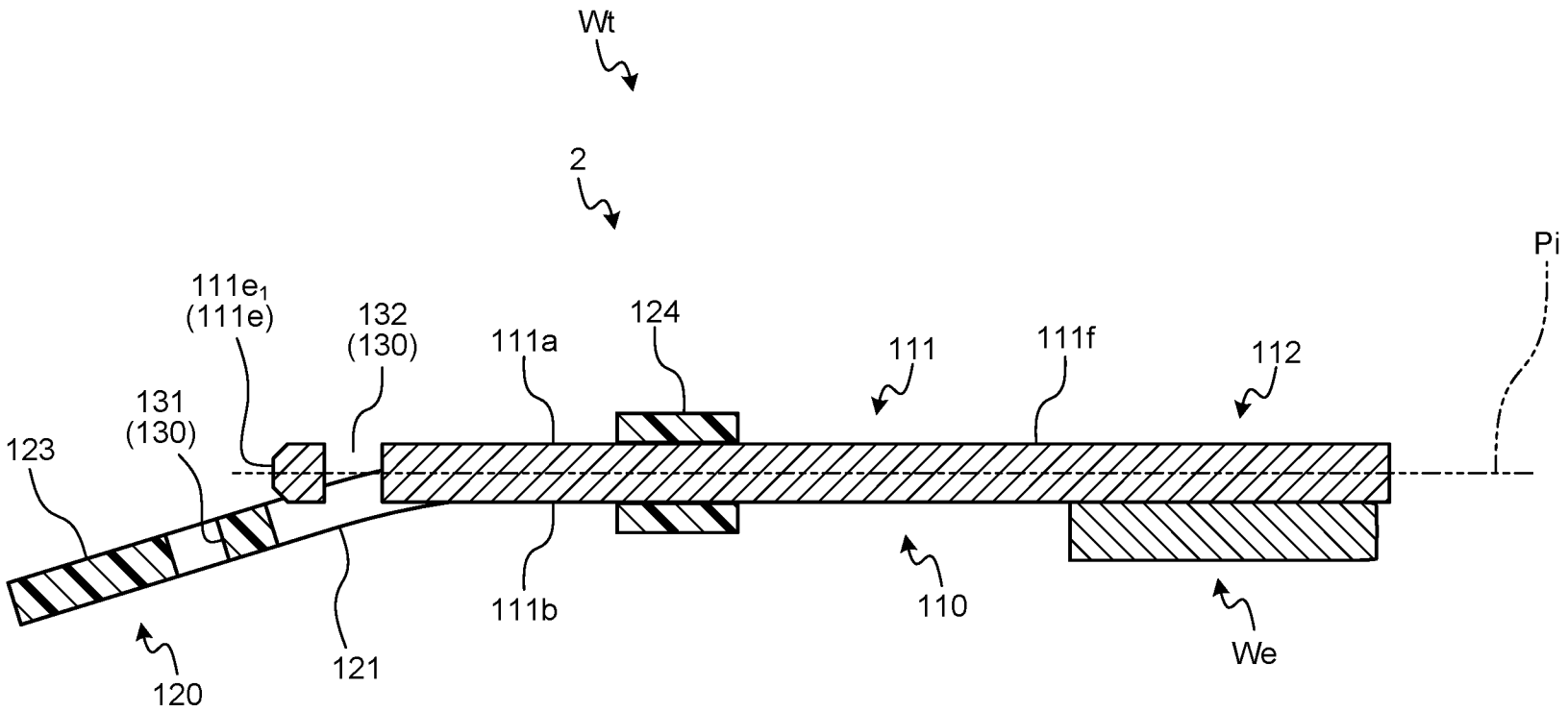
FIG. 25 is a cross-sectional view for explaining a step of attaching a covering member to a terminal fitting.
Figure 26:
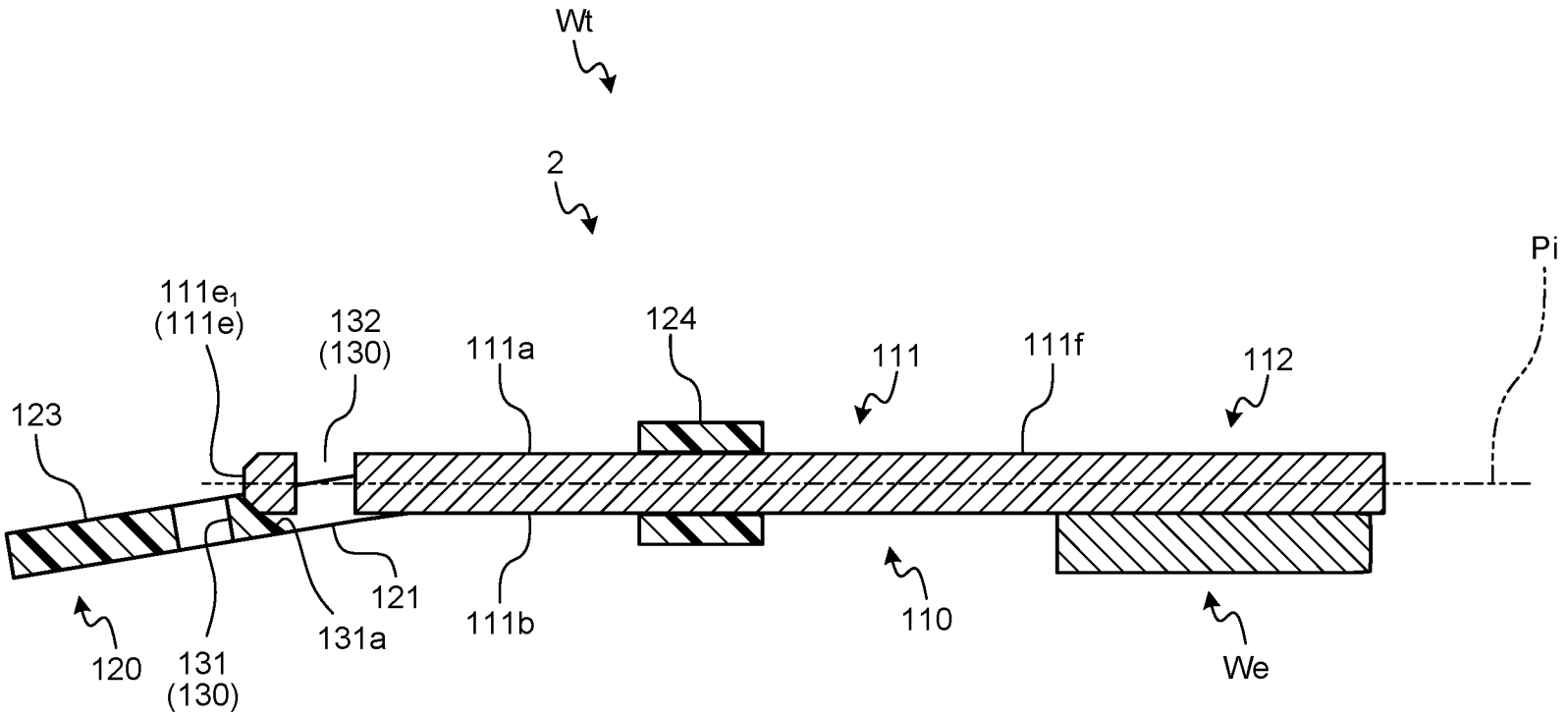
FIG. 26 is a cross-sectional view for explaining the step of attaching the covering member to the terminal fitting, illustrating a modified form of the covering member.

In the connection terminal 2 and the terminal-equipped electric wire Wt of the present modification described above, the terminal fitting 110 is inserted into the through hole 124*a* of the coupling portion 124 of the covering member 120 from the front end 111*e* of the electrical connection portion 111 (FIG. 19). In the connection terminal 2 and the terminal-equipped electric wire Wt, the first main covering portion 121 and the second main covering portion 122 are elastically deformed and bent in the direction orthogonal to both the virtual axis direction and the opposing direction of the first main covering portion 121 and the second main covering portion 122 (FIGS. 25 and 26). The first main covering portion 121 and the second main covering portion 122 are bent to positions where the respective locking protrusions 131 do not lock the side at the front end 111*e* of the electrical connection portion 111. In the connection terminal 2 and the terminal-equipped electric wire Wt, while the first main covering portion 121 and the second main covering portion 122 are being bent as described above, the respective locking protrusions 131 of the first main covering portion 121 and the second main covering portion 122 are inserted into the respective locking grooves 132 of the first covering target portions 113 of the first end surface 111*c* and the second end surface 111*d* (FIG. 24). In the connection terminal 2 and the terminal-equipped electric wire Wt, with the pair of each locking protrusion 131 and each locking groove 132 brought into the lock state as described above, the first covering target portions 113 of the first end surface 111*c* and the second end surface 111*d* are covered with the first main covering portion 121 and the second main covering portion 122. Additionally, the second covering target portion $\mathbf{111}e_1$ at the front end 111*e* is covered with the sub covering portion 123.

In the connection terminal 2 and the terminal-equipped electric wire Wt, for example, an operator elastically deforms and bends the first main covering portion 121 and the second main covering portion 122 with the sub covering portion 123 as a point of force application, or a jig or the like is used to elastically deform and bend the first main covering portion 121 and the second main covering portion 122 with the sub covering portion 123 as a point of force application (FIG. 25). When the coupling portion 124 abuts against positioning protrusions 114 (FIGS. 16 to 18 and 20 to 22) individually protruded from the first end surface 111*c* and the second end surface 111*d* in the above state, the bending of the first main covering portion 121 and the second main covering portion 122 is eliminated. This enables the respective locking protrusions 131 of the first main covering portion 121 and the second main covering portion 122 to be inserted into the respective locking grooves 132 of the first covering target portions 113 of the first end surface 111*c* and the second end surface 111*d* in the connection terminal 2 and the terminal-equipped electric wire Wt (FIG. 24).

The locking protrusion 131 of the first main covering portion 121 may have an inclined surface 131*a* that is inclined to a travel direction of the electrical connection portion 111 in attaching the covering member 120 to the terminal fitting 110, with respect to an insertion and removal direction of the pair of the locking protrusion 131 and the locking groove 132 (FIG. 26). The locking protrusion 131 of the second main covering portion 122 may also have an inclined surface 131*a* that is inclined to the travel direction of the electrical connection portion 111, with respect to the insertion and removal direction of the pair of the locking protrusion 131 and the locking groove 132 (FIG. 26). In this case, in the connection terminal 2 and the terminal-equipped electric wire Wt, the electrical connection portion 111 is inserted into the through hole 124*a* of the coupling portion 124 and moved until the front end 111*e* of the electrical connection portion 111 abuts against the inclined surfaces 131*a* of the respective locking protrusions 131. The respective inclined surfaces 131*a* convert a force received from the front end 111*e* of the electrical connection portion 111 into a force in the direction to bend the first main covering portion 121 and the second main covering portion 122. That is, in the connection terminal 2 and the terminal-equipped electric wire Wt, the front end 111*e* of the electrical connection portion 111 elastically deforms and bends the first main covering portion 121 and the second main covering portion 122 while traveling along the inclined surfaces 131*a* of the respective locking protrusions 131 (FIG. 26). In the connection terminal 2 and the terminal-equipped electric wire Wt, the respective locking protrusions 131 climb on the second wall surface 111*b* (or the first wall surface 111*a* when the inclined surfaces 131*a* are inclined in an opposite direction) at the front end 111*e*, and then climb over the second wall surface 111*b* (or the first wall surface 111*a*) at the front end 111*e* to eliminate the bending of the first main covering portion 121 and the second main covering portion 122. The respective locking protrusions 131 of the first main covering portion 121 and the second main covering portion 122 are thereby inserted into the respective locking grooves 132 of the first covering target portions 113 of the first end surface 111*c* and the second end surface 111*d*.

As described above, in the connection terminal 2 and the terminal-equipped electric wire Wt of the present modification, each of the first main covering portion 121 and the second main covering portion 122 of the covering member 120 is provided with one of the locking protrusion 131 and the locking groove 132, and is given flexibility. Thus, the covering member 120 can be attached to the terminal fitting 110 only by inserting the terminal fitting 110 provided with the other of the locking protrusion 131 and the locking groove 132 into the covering member 120 similarly to the connection terminal 1 and the terminal-equipped electric wire Wt of the embodiment. Consequently, the connection terminal 2 and the terminal-equipped electric wire Wt can easily prevent a finger touch on the terminal fitting 110 similarly to the connection terminal 1 and the terminal-equipped electric wire Wt of the embodiment. Additionally, since the connection terminal 2 and the terminal-equipped electric wire Wt of the present modification employ such a simple structure, the terminal fitting 110 and the covering member 120 can be made of a variety of materials and formed in a variety of shapes similarly to the connection terminal 1 and the terminal-equipped electric wire Wt of the embodiment. This also makes it easier to achieve the finger-touch prevention for the terminal fitting 110. Moreover, in the connection terminal 2 and the terminal-equipped electric wire Wt of the present modification, it is not necessary to increase the number of steps of forming the shape (the locking grooves 132) used for attaching the covering member 120 in forming the terminal fitting 110 similarly to the connection terminal 1 and the terminal-equipped electric wire Wt of the embodiment. Thus, the connection terminal 2 and the terminal-equipped electric wire Wt have excellent productivity.

Furthermore, in the connection terminal 2 and the terminal-equipped electric wire Wt of the present modification, not only the first covering target portions 113 of the first end surface 111*c* and the second end surface 111*d*, but also the second covering target portion 111$e_1$ at the front end 111*e* in the electrical connection portion 111 can be covered with the covering member 120. Thus, the connection terminal 2 and the terminal-equipped electric wire Wt of the present modification can be applied to not only the connector 501 of the embodiment, but also the connector disclosed in Japanese Patent Application Laid-open No. 2019-3744 as described above.

Figure 27:
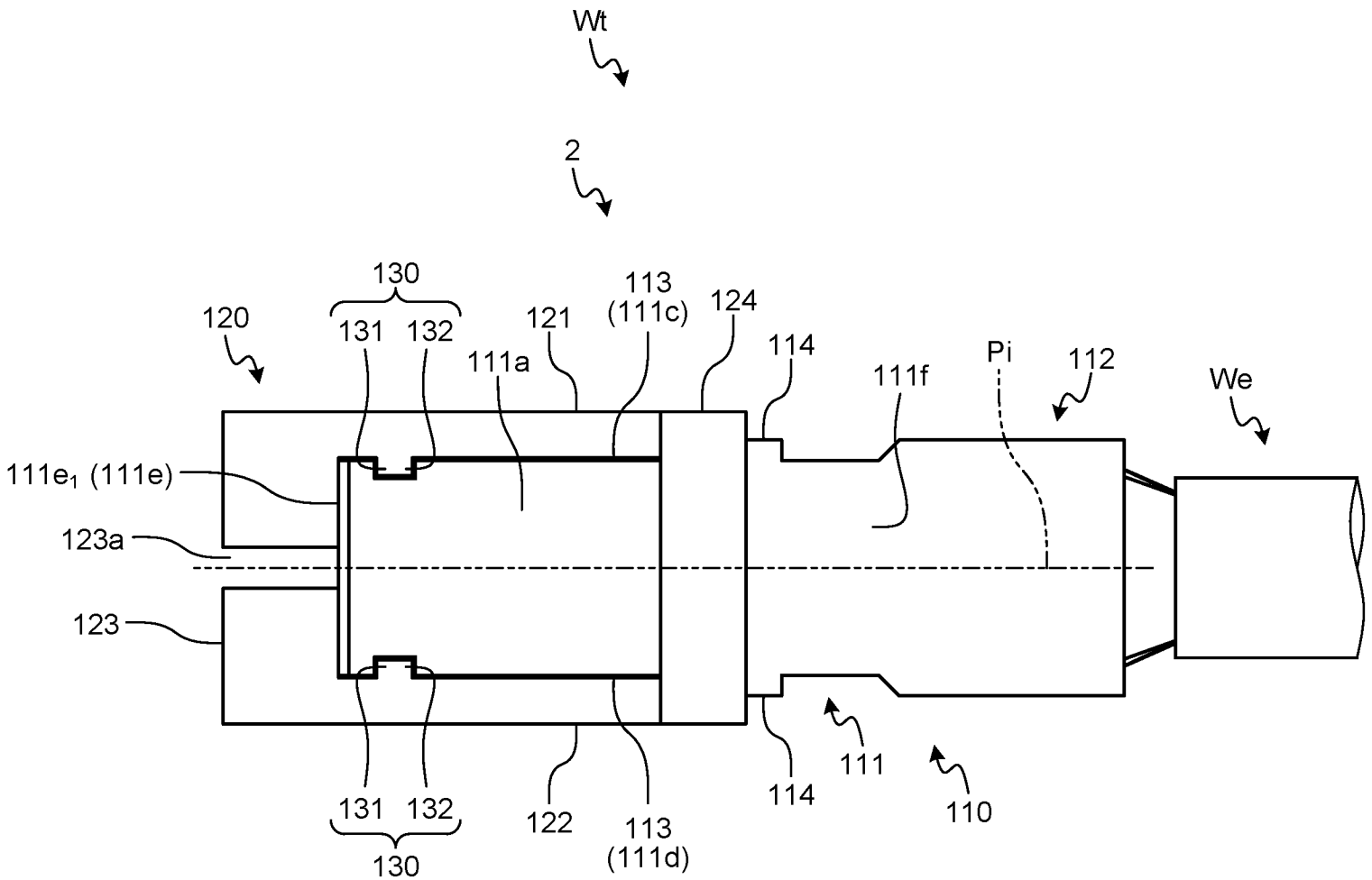
FIG. 27 is a plan view of the connection terminal and the terminal-equipped electric wire of the modification as viewed from the contact portion side, illustrating a modified form of the covering member.

The covering member 120 of the present modification may be provided with a cutout 123*a* in the sub covering portion 123 so as to divide the sub covering portion 123 into an area close to the first main covering portion 121 and an area close to the second main covering portion 122 (FIG. 27). The cutout 123*a* is formed in such a size as not to allow a finger touch on the second covering target portion 111$e_1$ at the front end 111*e*. The cutout 123*a* is formed in the sub covering portion 123 in this example in substantially the center in the opposing direction of the first main covering portion 121 and the second main covering portion 122. By using the covering member 120 provided with the cutout 123*a* as described above, the first main covering portion 121 and the second main covering portion 122 in the connection terminal 2 and the terminal-equipped electric wire Wt of the present modification can be bent in the same directions as the first covering portion 21 and the second covering portion 22 in the connection terminal 1 and the terminal-equipped electric wire Wt of the embodiment. That is, the connection terminal 2 and the terminal-equipped electric wire Wt of the present modification enable the covering member 120 to be attached to and detached from the terminal fitting 110 in the same manner as the connection terminal 1 and the terminal-equipped electric wire Wt of the embodiment.

In the connection terminal 2 and the terminal-equipped electric wire Wt of the present modification, the covering member 120 may be formed in a shape matching the terminal fitting 10 of the embodiment. Consequently, the connection terminal 1 of the embodiment and the connection terminal 2 of the present modification can be fabricated by using the common terminal fitting 10.

In the connection terminal and the terminal-equipped electric wire according to the present embodiments, each of the two covering portions of the covering member is provided with one of the locking protrusion and the locking groove, and is given flexibility. Thus, the covering member can be attached to the terminal fitting only by inserting the terminal fitting provided with the other of the locking protrusion and the locking groove into the covering member. Consequently, the connection terminal and the terminal-equipped electric wire can easily prevent the finger touch on the terminal fitting.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connection terminal comprising:

a terminal fitting;

an insulating covering member attachable to and detachable from the terminal fitting from one end in a virtual axis direction of the terminal fitting along the virtual axis direction; and a locking structure provided between the terminal fitting and the covering member and configured to undetachably lock the covering member to the terminal fitting, wherein the covering member includes two covering portions configured to sandwich and cover, in a direction orthogonal to the virtual axis direction, covering target portions disposed at opposite ends in the orthogonal direction of the terminal fitting, the covering target portions are areas capable of being finger-touch prevention targets to be prevented from being touched by a finger when accommodated within a casing of a connector, the locking structure includes, for each of combinations of the covering target portions and the covering portions arranged opposite to each other in the orthogonal direction, a locking protrusion provided in one of the covering target portion and the covering portion, and a locking groove provided in the other of the covering target portion and the covering portion and configured to lock the locking protrusion in the virtual axis direction when the locking protrusion is inserted thereinto, and each of the covering portions has such flexibility as to enable elastic deformation along a lock release direction for releasing a lock state between the locking protrusion and the locking groove for the covering portion such that the covering member can be replaceably removed from the terminal fitting.

2. The connection terminal according to claim 1, wherein the pair of the locking protrusion and the locking groove is formed to set the orthogonal direction as the lock release direction.

3. The connection terminal according to claim 1, wherein the covering member includes a sub covering portion configured to cover an end surface at the end in the virtual axis direction of the terminal fitting in addition to two main covering portions as the covering portions.

4. The connection terminal according to claim 3, wherein the sub covering portion is coupled to each of the two main covering portions, and the pair of the locking protrusion and the locking groove is formed to set a direction orthogonal to both the virtual axis direction and an opposing direction of the two main covering portions as the lock release direction.

5. The connection terminal according to claim 1, wherein the terminal fitting includes an electrical connection portion formed in a rectangular plate shape, at least one of two flat surfaces along the virtual axis direction of the electrical connection portion being used as a contact portion with a mating connection terminal, and the covering target portions are individually disposed on end surfaces on two sides along the virtual axis direction of the electrical connection portion.

6. The connection terminal according to claim 2, wherein the terminal fitting includes an electrical connection portion formed in a rectangular plate shape, at least one of two flat surfaces along the virtual axis direction of the electrical connection portion being used as a contact portion with a mating connection terminal, and the covering target portions are individually disposed on end surfaces on two sides along the virtual axis direction of the electrical connection portion.

7. The connection terminal according to claim 3, wherein the terminal fitting includes an electrical connection portion formed in a rectangular plate shape, at least one of two flat surfaces along the virtual axis direction of the electrical connection portion being used as a contact portion with a mating connection terminal, and the covering target portions are individually disposed on end surfaces on two sides along the virtual axis direction of the electrical connection portion.

8. The connection terminal according to claim 4, wherein the terminal fitting includes an electrical connection portion formed in a rectangular plate shape, at least one of two flat surfaces along the virtual axis direction of the electrical connection portion being used as a contact portion with a mating connection terminal, and the covering target portions are individually disposed on end surfaces on two sides along the virtual axis direction of the electrical connection portion.

9. A terminal-equipped electric wire comprising:

an electric wire; and a connection terminal physically and electrically connected to the electric wire, wherein the connection terminal includes: a terminal fitting; an insulating covering member attachable to and detachable from the terminal fitting from one end in a virtual axis direction of the terminal fitting along the virtual axis direction; and a locking structure provided between the terminal fitting and the covering member and configured to undetachably lock the covering member to the terminal fitting, the covering member includes two covering portions configured to sandwich and cover, in a direction orthogonal to the virtual axis direction, covering target portions disposed at opposite ends in the orthogonal direction of the terminal fitting, the covering target portions are areas capable of being finger-touch prevention targets to be prevented from being touched by a finger when accommodated within a casing of a connector, the locking structure includes, for each of combinations of the covering target portions and the covering portions arranged opposite to each other in the orthogonal direction, a locking protrusion provided in one of the covering target portion and the covering portion, and a locking groove provided in the other of the covering target portion and the covering portion and configured to lock the locking protrusion in the virtual axis direction when the locking protrusion is inserted thereinto, and each of the covering portions has such flexibility as to enable elastic deformation along a lock release direction for releasing a lock state between the locking protrusion and the locking groove for the covering portion such that the covering member can be replaceably removed from the terminal fitting.

* * * * *